US011832731B2

(12) United States Patent
Sun

(10) Patent No.: US 11,832,731 B2
(45) Date of Patent: Dec. 5, 2023

(54) TELESCOPIC STOOL

(71) Applicant: Ningbo Tenghao Outdoor Co., Ltd., Ningbo (CN)

(72) Inventor: Liang Sun, Ningbo (CN)

(73) Assignee: NINGBO TENGHAO OUTDOOR CO., LTD., Ningbo (CN)

( * ) Notice: Subject to any disclaimer, the term of this patent is extended or adjusted under 35 U.S.C. 154(b) by 77 days.

(21) Appl. No.: 17/342,532

(22) Filed: Jun. 8, 2021

(65) Prior Publication Data

US 2022/0061534 A1 Mar. 3, 2022

Related U.S. Application Data

(63) Continuation-in-part of application No. PCT/CN 2021/079326, filed on Mar. 5, 2021.

(30) Foreign Application Priority Data

Aug. 26, 2020 (CN) ..... 202010872517.5
Sep. 21, 2020 (CN) ..... 202010995000.5

(51) Int. Cl.
*A47C 3/16* (2006.01)
*A47C 3/40* (2006.01)
(Continued)

(52) U.S. Cl.
CPC ..... *A47C 3/40* (2013.01); *A47C 3/16* (2013.01); *A47C 4/52* (2013.01); *A47C 7/727* (2018.08);
(Continued)

(58) Field of Classification Search
CPC .... A47C 3/40; A47C 3/16; A47C 4/52; A47C 7/727; A47C 7/002; A47C 7/72;
(Continued)

(56) References Cited

U.S. PATENT DOCUMENTS 1,093,873 A * 4/1914 Mitchell ..... B65D 21/086 220/8
3,715,996 A * 2/1973 Rolfshus ..... A47C 9/00 D6/692.3
(Continued)

FOREIGN PATENT DOCUMENTS

CN 2535597 Y * 2/2003
CN 209518567 U * 10/2019
(Continued)

OTHER PUBLICATIONS 3 page PDF of machine translation of CN 2535597Y. (Year: 2003).*
(Continued)

*Primary Examiner* — Robert Canfield
(74) *Attorney, Agent, or Firm* — MATTHIAS SCHOLL P.C.; Matthias Scholl

(57) ABSTRACT

A telescopic stool, including: a stool surface, a stool base, a telescopic mechanism, and a transition mechanism for connecting the stool surface to the telescopic mechanism; wherein the telescopic mechanism is able to be switched between an unfolded state and a contracted state; the telescopic mechanism includes a plurality of connecting pieces capable of moving relative to each other and a fixation mechanism disposed on the plurality of connecting pieces; and the fixation mechanism is configured to keep the telescopic mechanism in the unfolded state.

24 Claims, 21 Drawing Sheets

(51) Int. Cl.

| | |
|---|---|
| ***A47C 4/52*** | (2006.01) |
| ***A47C 7/72*** | (2006.01) |
| *A47C 9/10* | (2006.01) |
| *A47G 19/22* | (2006.01) |
| *A45F 3/20* | (2006.01) |

(52) U.S. Cl.
CPC ..... *A45F 2003/205* (2013.01); *A47G 2019/2277* (2013.01)

(58) Field of Classification Search
CPC .. A47C 7/725; A47C 9/10; A47C 4/04; A47C 7/00; A47C 3/20; A47C 9/00; A45F 2003/205; A47G 2019/2277
See application file for complete search history.

(56) References Cited

U.S. PATENT DOCUMENTS

| | | | | | |
|---|---|---|---|---|---|
| 5,156,454 | A * | 10/1992 | White | F21V 19/007 | 362/153.1 |
| 5,771,507 | A * | 6/1998 | Healy | E03C 1/22 | 4/651 |
| 6,467,843 | B1 * | 10/2002 | Rossborough | A47C 9/10 | 108/150 |
| 9,016,491 | B2 * | 4/2015 | Blum | B65D 81/3869 | 220/4.33 |
| D797,908 | S * | 9/2017 | Dam | D23/299 | |
| D873,042 | S * | 1/2020 | Dai | D6/335 | |
| D878,067 | S * | 3/2020 | You | D6/353 | |
| D891,798 | S * | 8/2020 | Dai | D6/335 | |
| D893,204 | S * | 8/2020 | Dai | D6/335 | |
| D899,117 | S * | 10/2020 | Dai | D6/351 | |
| D918,609 | S * | 5/2021 | Zhao | D6/353 | |
| D936,382 | S * | 11/2021 | Long | D6/353 | |
| D938,207 | S * | 12/2021 | Long | D6/686 | |
| 11,369,239 | B2 * | 6/2022 | Yang | A47K 11/04 | |
| D957,834 | S * | 7/2022 | Sun | D6/353 | |
| D959,865 | S * | 8/2022 | Dai | D6/352 | |
| 2012/0248106 | A1 * | 10/2012 | Marta | B65D 21/086 | 220/8 |
| 2013/0042583 | A1 * | 2/2013 | Wardle | B65F 1/068 | 53/473 |
| 2013/0181000 | A1 * | 7/2013 | Miksovsky | A45F 3/20 | 220/780 |
| 2015/0291309 | A1 * | 10/2015 | McGregor | B65D 21/086 | 220/573.1 |
| 2017/0340496 | A1 * | 11/2017 | Hochman | A47C 3/40 | |
| 2020/0015592 | A1 * | 1/2020 | Zaifman | A47B 3/002 | |
| 2022/0081163 | A1 * | 3/2022 | Adams | B65D 21/086 | |
| 2022/0087427 | A1 * | 3/2022 | Sun | A47C 3/40 | |

FOREIGN PATENT DOCUMENTS

| | | | | |
|---|---|---|---|---|
| CN | 210383292 | U * | 1/2020 | |
| JP | 2012154445 | A * | 8/2012 | F16B 7/105 |

OTHER PUBLICATIONS 6 page PDF of machine translation of CN 209518567U. (Year: 2019).*
6 page PDF of machine translation of CN 210383292U. (Year: 2020).*

* cited by examiner

TELESCOPIC STOOL

CROSS-REFERENCE TO RELATED APPLICATIONS

This application is a continuation-in-part of International Patent Application No. PCT/CN2021/079326 with an international filing date of Mar. 5, 2021, designating the United States, now pending, and further claims foreign priority benefits to Chinese Patent Application No. 202010872517.5 filed Aug. 26, 2020, and to Chinese Patent Application No. 202010995000.5 filed Sep. 21, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the technical field of stools, and more particularly to a telescopic stool.

As the leisure furniture commonly used in people's lives, stools are widely used in people's daily life in various locations, such as bedrooms, offices, laboratories and outdoor places. Conventional stools have a fixed shape and size, and are bulky and not portable. In recent years, telescopic stools including a telescopic structure have been developed. After stretched, the telescopic stools need to be supported by a reliable support force. Although the existing telescopic structures are able to realize a telescopic function, the support effects of the telescopic structures need to be improved, and the load-bearing capacities of the telescopic stools are limited.

SUMMARY

To overcome the deficiencies in the related art, the disclosure provides a telescopic structure with a firm structure.

To achieve the above objective, the disclosure provides a telescopic stool, comprising a stool surface, a stool base, a telescopic mechanism, and a transition mechanism for connecting the stool surface to the telescopic mechanism. The telescopic mechanism is able to be switched between an extended state and a contracted state. The telescopic mechanism comprises a plurality of connecting pieces capable of moving relative to each other and a fixation mechanism disposed on the plurality of connecting pieces. The fixation mechanism is configured to keep the telescopic mechanism in the extended state. After the plurality of connecting pieces are extended, the extended connecting pieces are fixed by the fixation mechanism, so that the connecting pieces are in the extended state. Thus, a better support effect is provided for the extended connecting pieces, and the reliability of the telescopic mechanism when in use is ensured.

Further, the fixation mechanism comprises a first limiting structure configured to provide axial limiting for the connecting pieces. After the plurality of connecting pieces are extended, a limiting effect is provided for the axial direction of the connecting pieces by the first limiting structure, and a support force is provided for the extended connecting pieces, so that the connecting pieces are effectively fixed at specified positions, the plurality of connecting pieces cooperate with each other to provide a stable support force, and the reliability of the telescopic mechanism when in use is ensured.

Further, the first limiting structure comprises first limiting portions disposed on the connecting pieces and second limiting portions matched with the first limiting portions on adjacent connecting pieces. After the telescopic mechanism is extended, a support force is provided for the connecting pieces by the limiting portions, so that the telescopic mechanism is kept in the extended state, and the reliability of the telescopic mechanism when in use is improved. By providing a support force for a previous connecting piece by using an adjacent connecting piece, the whole telescopic mechanism becomes more compact, the structural strength of the telescopic mechanism is increased, and the telescopic mechanism becomes firmer when in use.

Further, the fixation mechanism further comprises a second limiting structure configured to provide circumferential limiting for the connecting pieces. After the plurality of connecting pieces are extended, a limiting effect is provided for the circumferential direction of the connecting pieces by the second limiting structure, so that the connecting pieces are unable to rotate. Thus, the connecting pieces are effectively fixed at specified positions, the plurality of connecting pieces cooperate with each other to provide a stable support force, and the reliability of the telescopic mechanism when in use is ensured.

Further, the second limiting structure comprises first slopes disposed on the first limiting portions and second slops disposed on the second limiting portions, and the first slopes are fitted with the second slopes on adjacent connecting pieces. After the connecting structure is extended, the second slops are located on the first slopes. Under the cooperation of the first slopes with the second slopes, the center of gravity of each of the first limiting portions is placed on the bottom end of the first slope, thus preventing the first limiting portion from falling out of the second limiting portion and improving the connection effect.

Further, the second limiting structure further comprises first rotation stopping portions disposed on the second limiting portions and second rotation portions matched with the first rotation stopping portions on adjacent connecting pieces. Thus, the circumferential limiting is further improved.

Further, the fixation mechanism further comprises a third limiting structure configured to provide radial limiting for the connecting pieces. Thus, the radial deformation of the connecting pieces is avoided, the structure becomes more stable, and it is possible to reduce the weight.

Further, the third limiting structure comprises fifth limiting portions disposed on the connecting pieces and sixth limiting portions matched with the fifth limiting portions on adjacent connecting pieces. Thus, radial limiting is realized.

Further, the telescopic mechanism further comprises a limiting structure for preventing two adjacent connecting pieces from separating from each other.

Further, a support mechanism for dispersing the stress of the connecting pieces is disposed on the connecting pieces. By arranging a support mechanism on the connecting pieces, the support capability of the connecting pieces is enhanced, so that it is possible to make the support pieces thinner, the connecting pieces have a larger support force in the case of a smaller thickness, and the quality of the telescopic stool in use is ensured. The connecting pieces are allowed to provide a same support force in the case of a smaller thickness by using the support mechanism, and the weight of the telescopic stool is reduced by thinning the connecting pieces. Thus, the overall weight of the telescopic stool is reduced, so that the telescopic stool is driven to move after the telescopic stool is contracted. Accordingly, the portable effect of the telescopic stool is more remarkable, and the market competitiveness of the telescopic stool is improved.

Further, the support mechanism comprises bearing components for providing an axial support force and reinforcing components for providing a radial support force. The bearing components cooperate with the reinforcing components to provide a support force for the connecting pieces in multiple directions, so that the telescopic stool has a larger support force when extended, and the structural strength of the telescopic stool is ensured. By providing the reinforcing components and the bearing components, the connecting pieces are allowed to have a same support force in the case of a smaller thickness. It is possible to adjust the thickness of the connecting pieces, so that the weight of the whole telescopic stool is reduced.

Further, the bearing components comprise a plurality of first bearing members disposed on inner walls of the connecting pieces and second bearing members for dispersing the stress of the first bearing members. The first bearing members play an overall support role, and the second bearing members cooperates with the first bearing members to play an auxiliary support role, thereby reducing the load of the first bearing members and protecting the first bearing members. The two bearing members cooperate with each other to provide a good support force for the connecting pieces, and effectively improve the structural strength of the connecting pieces.

Further, the reinforcing components comprise third bearing members disposed obliquely and fourth bearing members matched with the third bearing members. Thus, the reinforcing effect is provided, the deformation resistance of the connecting pieces is improved, and the support effect on the stool surface will not be affected when the connecting pieces are deformed when being squeezed.

Further, the third bearing members and the fourth bearing members are crossed with each other. The two bearing members form a triangular structure, so the support effect of the reinforcing component on the connecting pieces is further improved by using the stability of the triangle, and the structural strength of the connecting pieces is effectively improved.

Further, bearing legs are disposed on the fourth bearing members. By providing the bearing legs, the stress direction of the fourth bearing members, the stress on the fourth bearing members is dispersed, and the support effect of the fourth bearing members on the connecting pieces is further improved.

Further, the telescopic stool further comprises an anti-escapement mechanism configured to keep the telescopic stool in the contracted state. When the telescopic stool is not in use, the telescopic stool is contracted by pressing the stool surface down, and the stool surface descend to the base and is then fixed to the base by the anti-escapement mechanism, so that the base and the stool surface form a whole. Thus, the connection effect of the base and the stool surface is ensured, the stool surface is prevented from escaping from the base after the telescopic stool is contracted, the structural stability of the telescopic stool is ensured, and the service life of the telescopic stool is prolonged.

Further, the anti-escapement mechanism comprises a fixation component for interlocking the stool surface and the stool base. Under the action of the fixation component, the stool surface is stably fixed to the base after the telescopic stool is contracted, the stool surface is prevented from escaping from the base, the structural stability of the telescopic stool is ensured, and the service life of the telescopic stool is prolonged.

Further, the fixation component comprises a first anti-escapement portion disposed on the stool surface and a second anti-escapement portion matched with the first anti-escapement portion. After the telescopic stool is contracted, the stool surface is located on the base, and the stool surface is fixed by the cooperation of the first anti-escapement portion with the second anti-escapement portion. Thus, the stool surface is impossible to separate from the base, a good fixation effect on the stool surface is achieved, and the stability of the telescopic stool during transportation is ensured.

Further, the anti-escapement mechanism further comprises an anti-escapement component for preventing the stool surface from moving away from the stool surface. By cooperating the anti-escapement component with the fixation component, the fixation effect of the stool surface and the base is further improved, and the stool surface is prevented from separating from the base during the transportation process of the telescopic stool.

Further, the anti-escapement component comprises a third anti-escapement portion connected to the stool surface and a fourth anti-escapement portion matched with the third anti-escapement portion.

Further, the anti-escapement component comprises an upper connecting portion disposed on the stool surface, a lower connecting portion disposed on the stool base and a resetting member for connecting the upper connecting portion and the lower connecting portion.

Further, the anti-escapement mechanism further comprises a limiting structure configured to prevent the connecting pieces from moving.

Further, the limiting structure comprises a sixth anti-escapement portion disposed on the stool base and a first transition member matched with the sixth anti-escapement portion.

Further, the telescopic stool further comprises luminous bodies for generating light and a light transmitting region for allowing the light to be transmitted therethrough. When in use of the telescopic stool, the telescopic stool lights under the action of the luminous bodies, so that the telescopic stool attract more attention of consumers, and the attractiveness of the telescopic stool is improved. The luminous bodies are able to emit light in various colors and also able to emit light with different intensities as required, so that the light plays a different role in a different situation. The light is available for heightening atmosphere or acting as a warning sign to maximize the functions of the telescopic stool, so that the functionality of the telescopic stool is greatly improved, and the prospect of sales of the telescopic stool is increased. By providing the light transmitting region to transmit the light emitted by the luminous bodies, the light generated by the luminous bodies is buffered, the light from the luminous bodies is prevented from directly irradiating a user's eyes, and the softness of the light is improved. Meanwhile, by providing the light transmitting region, the hazy beauty of the telescopic stool during lighting is increased, the aesthetic degree of the telescopic stool is improved, and the prospect of sales of the telescopic stool is further increased.

Further, the light transmitting region is a hollow structure running through one or more of the stool surface, the stool base and the connecting pieces. By arranging the light transmitting region on any one of the stool surface, the base and the connecting pieces, a specified region on the telescopic stool is lighted. By lighting different regions of the telescopic stool, the telescopic stool has multiple different functions, so that different requirements for the telescopic in different multiple scenarios are satisfied, and the functionality of the telescopic stool is improved.

Further, the light transmitting region is a groove structure disposed on one or more of the stool surface, the stool base and the connecting pieces. By providing the groove, the distance from the luminous bodies to the outside is reduced, and it is easier to transmit the light from the luminous bodies, so that the light is prevented from directly irradiating the user's eyes, the softness of the light is improved, and the effect of heightening atmosphere is achieved by the telescopic stool.

Further, the hollow structure is an opening formed on the stool surface. The light emitted by the luminous bodies is transmitted through the opening on the stool surface, and the luminous bodies are able to emit light in various different colors. Meanwhile, by controlling the luminous bodies to blink at intervals, the light generated by the luminous bodies is transmitted from the stool surface, so that it is possible to place the telescopic stool at a construction site to act as a warning sign.

Further, the hollow structure is openings formed on the connecting pieces. The openings on the connecting pieces are possibly designed as a company logo or other delicate patterns. The light generated by the luminous bodies during operation is transmitted out from the openings on the connecting pieces, so that the pattern at the openings on the connecting pieces is mapped onto a wall, thereby achieving the advertising or beautifying effect, meeting more consumers' taste, and increasing the market prospect of the telescopic stool.

Further, the luminous bodies are disposed on one or more of the stool surface, the stool base and the connecting pieces. By arranging the luminous bodies at different positions, the luminous bodies are allowed to correspond to different light transmitting regions on the telescopic stool, so that the distance from the luminous bodies to the light transmitting region is reduced. Thus, the light from the luminous bodies is normally transmitted from the light transmitting region, the striking degree of the light is increased, and an obvious warning effect is achieved when the telescopic stool acts as a warning sign.

Further, the telescopic stool further comprises a light reflecting region for reflecting the light. By providing the light reflecting region, it is possible to directly observe the telescopic stool in a region with weak light so as to determine the position of the telescopic stool. The light emitted by the luminous bodies is reflected by the light reflecting region, so the intensity of light from the luminous bodies is further increased, light with higher brightness is obtained by using luminous bodies with lower power, the service life of batteries is prolonged, and it is more convenient to use the telescopic stool.

Further, the telescopic stool further comprises a mounting portion disposed on the stool surface, a cover plate matched with the mounting portion, and a locking structure for connecting the mounting portion and the cover plate.

Further, the locking structure comprises a mounting groove formed on the cover plate and a clamping member matched with the mounting groove.

Further, the telescopic stool further comprises an extended structure capable of providing auxiliary functions.

Further, the extended structure comprises one or more of a sound box, a wireless charging component, a buzzer and a photovoltaic charging component. By mounting an extended structure with various different functions on the telescopic stool, the telescopic stool has more functions in daily use, different requirements of consumers for the telescopic stool are satisfied, and the practicability of the telescopic stool is improved.

In conclusion, in the disclosure, by providing the fixation mechanism, the extended connecting pieces are fixed, the connected pieces are allowed to be in the extended state, a good support effect is provided for the extended connecting pieces, and the reliability of the telescopic mechanism when in use is ensured.

DETAILED DESCRIPTION

Preferred implementations of the disclosure will be described below in detail with reference to the accompanying drawings. To make those skilled in the art better understand the solutions in the disclosure, the technical solutions in the embodiments of the disclosure will be clearly and completely described below with reference to the accompanying drawings in the embodiments of the disclosure. The words "first", "second" and the like in the disclosure are merely used to distinguish different components having the same name for convenience of description, and do not indicate any precedence or primary and secondary relationship.

Example 1

Figure 1:
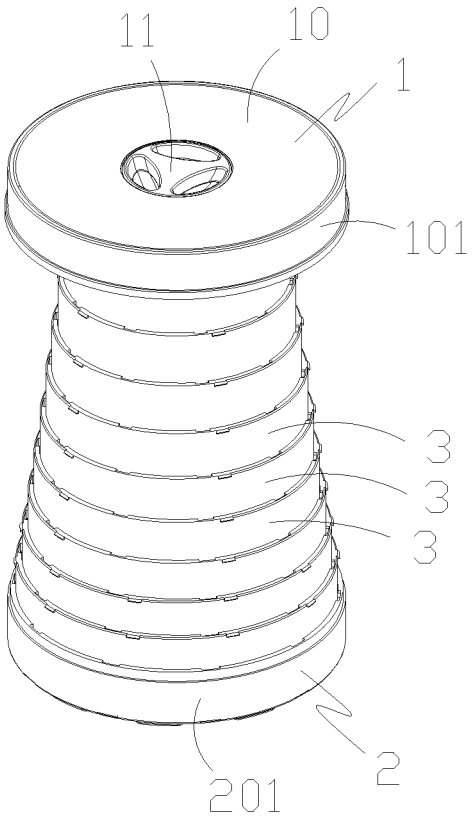
FIG. 1 is a stereoscopic structure diagram of a telescopic stool in an extended state according to Example 1 of the disclosure.

As shown in FIG. 1, a telescopic stool is provided, comprising stool surface 1, a stool base 2, a telescopic mechanism, a first transition mechanism and a second transition mechanism. The telescopic mechanism comprises a plurality of connecting pieces 3 capable of moving relative to each other. The plurality of connecting pieces 3 are connected end to end, and the connecting pieces are disposed in a circular ring structure. The plurality of connecting pieces sequentially increase in diameter from the top down, so that the telescopic mechanism is able to be switched between an extended state and a contracted state. When every two adjacent connecting pieces move away from each other to the most distal end, the telescopic mechanism is in a completely extended state; and, when every two adjacent connecting pieces move close to each other to overlap or overlap mostly, the telescopic mechanism is in a completely contracted state. The telescopic mechanism further comprises a fixation mechanism for keeping the telescopic mechanism in the extended state (even if two adjacent connecting pieces are kept away from each other). The stool surface 1 is connected to the uppermost connecting piece 3 of the telescopic mechanism, while the stool base 2 is connected to the lowermost connecting piece 3 of the telescopic mechanism. The first transition mechanism is used for connecting the stool surface 1 to the telescopic mechanism, and the second transition mechanism is used for connecting the stool base 2 to the telescopic mechanism.

Specifically, the fixation mechanism comprises a first limiting structure configured to provide axial limiting for the connecting pieces 3 and a second limiting structure configured to provide circumferential limiting for the connecting pieces 3. The first limiting structure comprises first limiting portions 31 disposed on the connecting pieces 3 and second limiting portions 32 matched with the first limiting portions 31 on adjacent connecting pieces 3. The first limiting portions are formed by extending outward at least parts of inner walls of the connecting pieces 3, and the second limiting portions are formed by extending outward at least parts of outer walls of the connecting pieces 3. When the telescopic mechanism is in the extended state, the second limiting portions 32 are located above the first limiting portions 31, and the first limiting portions 31 axially support the second limiting portions, so that a previous connecting piece is prevented from contracting into a next connecting piece even if two adjacent connecting pieces are kept in a relatively extended state.

Figure 6:
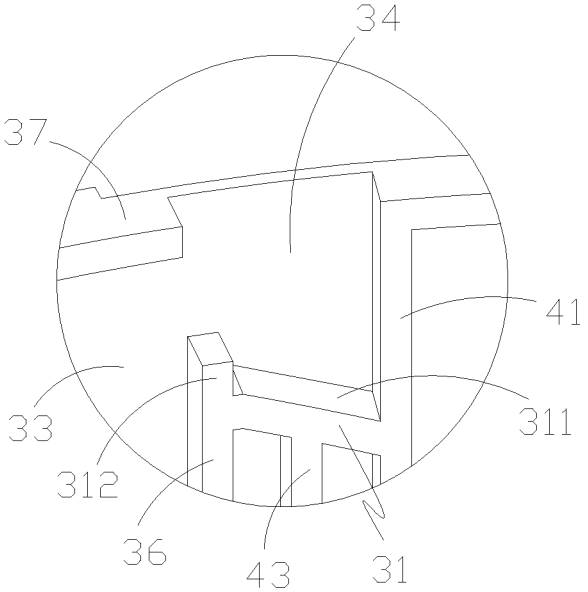
FIG. 6 is an enlarged view of part A in FIG. 5.

As shown in FIG. 6, in some embodiments, a first movement region 33 for allowing movement of the second limiting portion 32 on an adjacent connecting piece and a second movement region 34 communicated with the first movement region 33 are disposed on each of the connecting pieces 3. At least part of an inner wall of each of the connecting pieces is extended outward to form a first projection 35 and a second projection 36, and the upper edge of at least part of the inner wall of each of the connecting pieces is extended outward to form a third projection 37. The first projection, the second projection and the third projection form an inverted U-shaped structure, and the first movement region 33 is formed between the first projection, the second projection and the third projection. The second movement region 34 is located above the first limiting portion 31 and communicated with the first movement region. The second limiting portion 32 is movable in the first movement region and the second movement region on an adjacent connecting piece, so it is convenient to switch the telescopic mechanism between the extended state and the contracted state.

Figure 7:
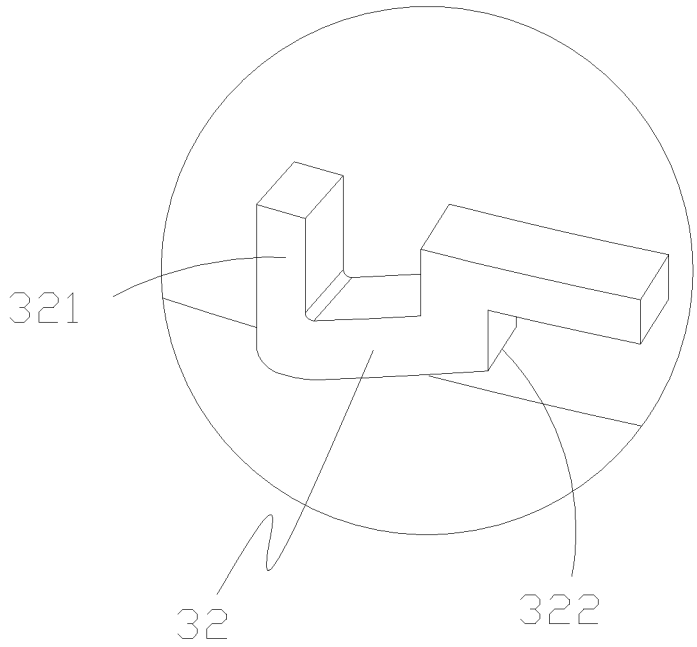
FIG. 7 is an enlarged view of part B in FIG. 5.
Figure 8:
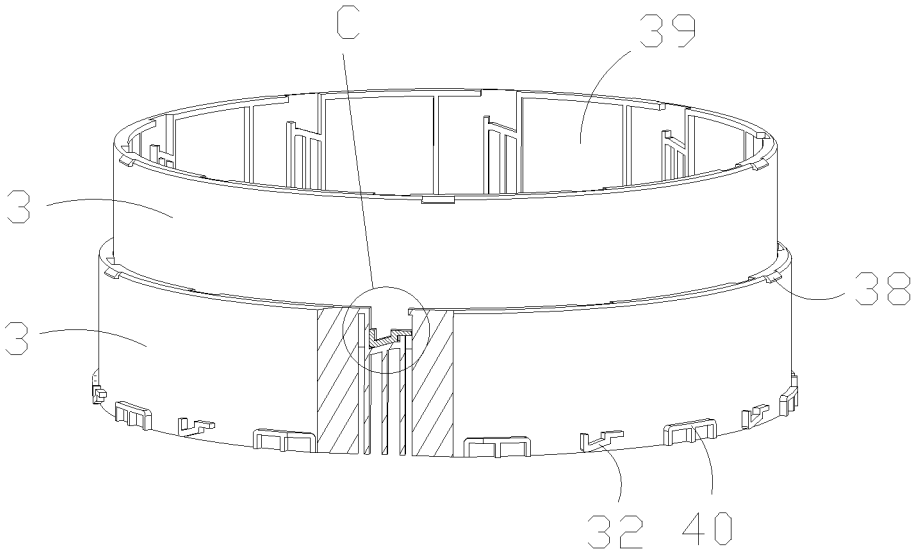
FIG. 8 is a stereoscopic diagram of the cooperation of two connecting pieces when the telescopic stool is extended according to Example 1 of the disclosure.
Figure 9:
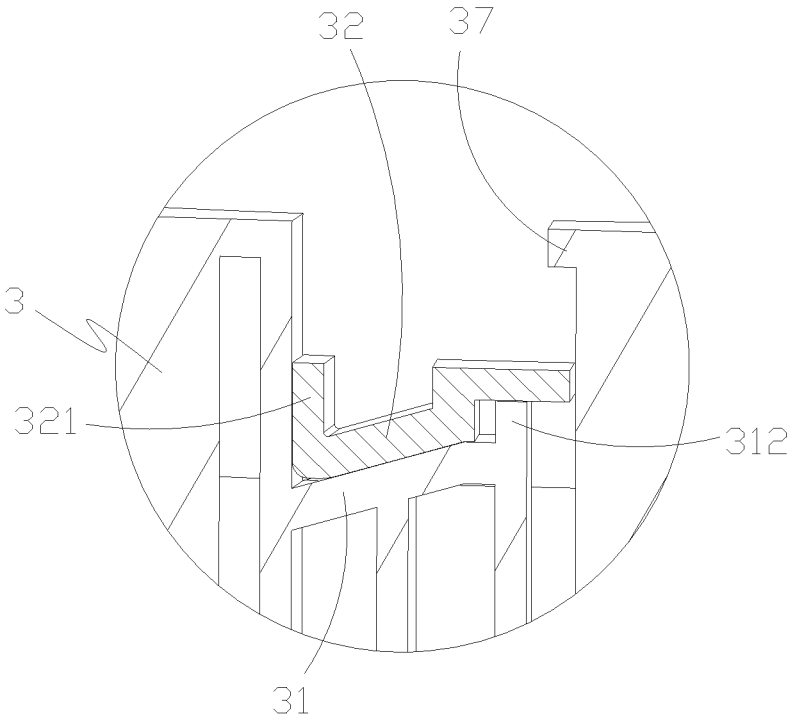
FIG. 9 is an enlarged view of part C in FIG. 8.
Figure 10:
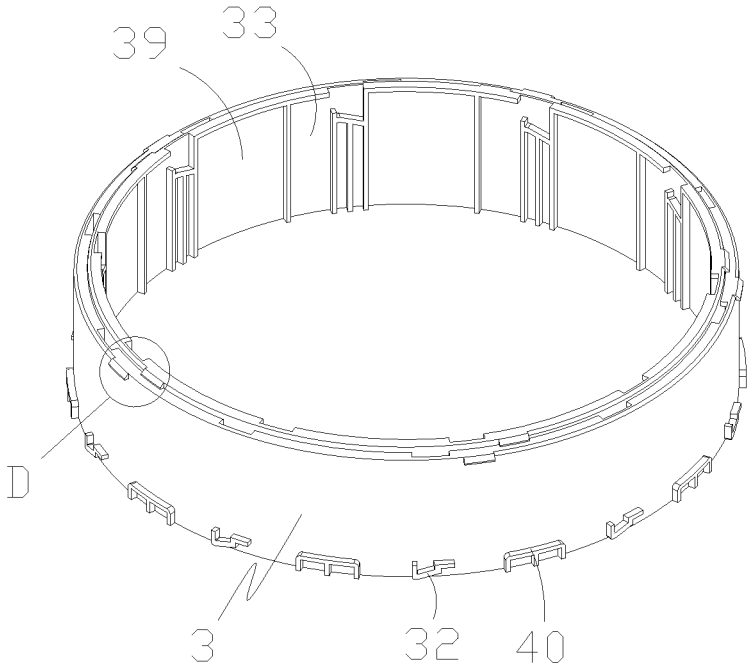
FIG. 10 is a stereoscopic diagram of the cooperation of two connecting pieces when the telescopic stool is contracted according to Example 1 of the disclosure.
Figure 11:
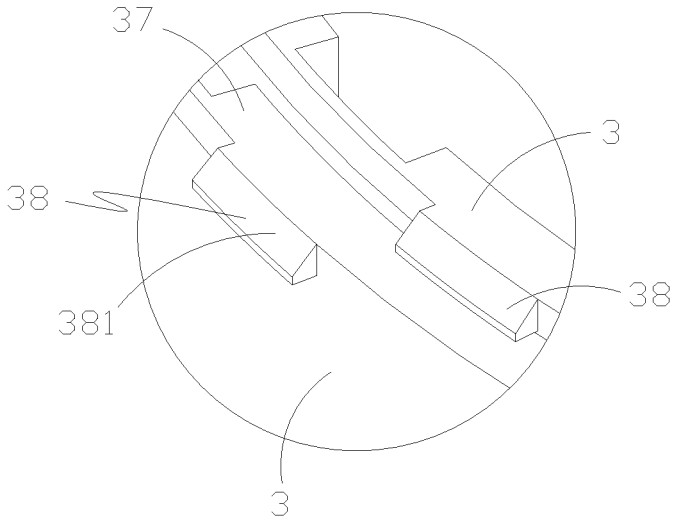
FIG. 11 is an enlarged view of part D in FIG. 10.

As shown in FIGS. 6 and 7, in some embodiments, the second limiting structure comprises first slope 311 disposed on the first limiting portions 31 and second slopes 322 disposed on the second limiting portions 32. The first slopes 311 are high on a side close to the first movement regions and low on a side away from the first movement regions. The first slopes 311 are fitted with the second slopes 322 on adjacent connecting pieces 3, so that after the first slopes 311 and the second slopes are resisted against each other due to an external force, the downward external force will apply a circumferential force to the connecting pieces under the action of the two slopes. This force allows the second limiting portions 32 on the connecting pieces to have a trend of moving away from the first movement regions, so that two adjacent connecting pieces can be kept in the extended state and will not be contracted accidently due to twisting, thus realizing higher safety.

As shown in FIGS. 6 and 7, in some embodiments, the second limiting structure further comprises first rotation stopping portions 321 disposed on the second limiting portions 32 and second rotation stopping portions 312 matched with the first rotation stopping portions 321 on adjacent connecting pieces 3. By resisting the second rotation stopping portions 312 against the first rotation stopping portions 321 on adjacent connecting pieces 3, the second limiting portions 32 are allowed to move close to the first movement regions even if the connecting pieces are rotated by a circumferential force. The first rotation stopping portions 321 on the second limiting portions 32 will also be blocked by the second rotation stopping portions 312, so that the second limiting portions 32 are impossible to enter the first movement regions 33. Thus, it is further ensured that two adjacent connecting pieces can be kept in the extended state, and it is safer and more stable in use.

In other embodiments, it is also possible to not provide the first rotation stopping portions 321, and it is also possible to realize circumferential limiting only by resisting ends of the second limiting portions 32 against the second rotation stopping portions 312.

As shown in FIGS. 5-11, in some embodiments, by pulling the stool surface 1 and the stool base 2, the stool surface 1 and the stool base 2 move away from each other, so that two adjacent connecting pieces 3 are driven to move away from each other, and the second limiting portion 32 on the upper connecting piece 3 will move up along the first movement region 33 on the lower connecting piece 3. After the second limiting portion 32 is resisted against the third projection 37, the stool surface 1 and the stool base 2 are rotated in opposite directions to drive the connecting pieces 3 to rotate, so that two adjacent connecting pieces 3 are rotated in opposite directions, and the second limiting portion 32 is moved in a direction away from the first projection 35 to enter the second movement region 34. By pressing down the stool surface 1, the stool surface 1 and the stool base 2 are moved close to each other, and the lower surface of the second limiting portion 322 will be resisted against the upper surface of the first limiting portion 31, so that the telescopic mechanism is kept in the extended state.

When it is necessary to fold the telescopic mechanism, the stool surface 1 is pulled upward, so that the stool surface 1 and the stool base 2 are moved away from each other. Thus, two adjacent connecting pieces 3 are driven to move away from each other, so that the second limiting portion on the upper connecting piece 3 is moved up to be resisted against the third projection 37. At this time, the second limiting portion 32 is located in the first movement region of the lower connecting piece. The stool surface is rotated, and the stool surface drives two adjacent connecting pieces to rotate in opposite directions, so that the second limiting portion 32 is rotated along with the connecting piece to enter the first movement region 33. By pressing down the stool surface 1, the stool surface pushes the connecting pieces to move down, so that the plurality of connecting pieces are contracted to from a circular ring until the stool surface 1 is resisted against the stool base 2. At this time, the telescopic mechanism is in the contracted state.

Further, third limiting portions 38 are further disposed on the connecting pieces 3. Defining a plane perpendicular to the axis of the connecting pieces 3 as a first reference plane, a projection of the third limiting portion 38 of any connecting piece 3 onto the first reference plane is at least partially overlapped with a projection of another adjacent connecting piece 3 close to a side of the stool base 2 onto the first reference plane. The third limiting portions are formed by extending outward at least parts of outer walls of the connecting pieces 3, and have trapezoidal cross-sections. The third limiting portions are disposed in a circumferential direction of the connecting pieces, and have a circumferential length that is far greater than its width and thickness. When the telescopic mechanism is in the contracted state, the third limiting portion 38 on the previous connecting piece 3 rests on the third projection 37 of the next connecting piece, so that the previous connecting piece will not fall out of the next connecting portion, and the stability of connection between two adjacent connecting pieces is maintained. A third slop 381 is formed on an upper surface of the third limiting portion 38, so that it is more convenient and labor-saving during assembling.

Further, third movement regions 39 and fourth limiting portions 40 matched with the third movement region 39 on adjacent connecting pieces 3 are further disposed on the connecting pieces 3. At least parts of inner walls of the connecting pieces 3 are extended outward to form fourth projections 41 and fifth projections 42. The third movement regions 39 are inverted U-shaped structures formed by the fourth projections 41, the fifth projections 42 and the third projections 37. The fourth limiting portions 40 are formed by extending outward at least parts of outer walls of the connecting pieces 3, and are disposed as an M-shaped structure. The fourth limiting portions 40 are movable in the third movement regions 39 on adjacent connecting pieces 3. The fourth limiting portions 40 have a width less than the width of the third movement regions 39, so that the second limiting portions 32 are allowed to move back and forth between the first movement regions 33 and the second movement region 34. The fourth limiting portions 40 are movable back and forth in the third movement regions 39, and will not influence the circumferential movement of the second limiting portions. The fourth limiting portions 40 have a width greater than the width of the first movement regions 33, so that the fourth limiting portions are impossible to enter the first movement regions. Thus, during assembling, an operator is able to align the fourth limiting portion with the third movement regions and align the second limiting portions with the first movement regions by only hand feeling, thus realizing quick mounting, improving the assembly efficiency and improving the production efficiency.

In other embodiments, it is also possible that the fourth limiting portions 40 are in other shapes, such as a line-shaped or inverted U-shaped, as long as the fourth limiting portions have a width greater than the width of the first movement regions 33 and less than the width of the third movement region 39. Thus, convenient connection between the connecting pieces is ensured, and the relative movement of the connecting pieces will not be affected.

As shown in FIG. 6, in some embodiments, sixth projections 43 are further disposed on the connecting pieces 3. The sixth projections are formed by extending outward at least parts of inner surfaces of the connecting pieces, and are connected to the first limiting portions 31 to support the first limiting portions 31, thereby enhancing the structural strength.

Figure 2:
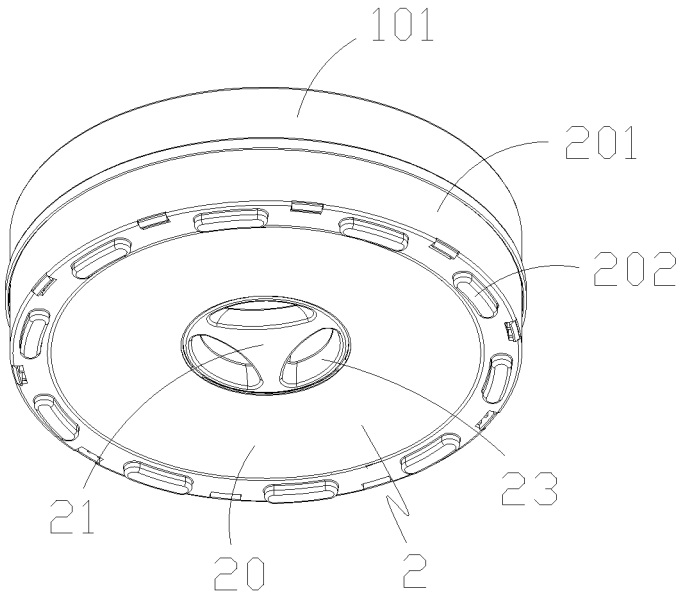
FIG. 2 is a stereoscopic structure diagram of a telescopic stool in a contracted state according to Example 1 of the disclosure.

As shown in FIGS. 1 and 2, in some embodiments, the stool surface 1 comprises an upper stool body 10, an upper grip 11 and an upper connecting portion 12. The stool base 2 comprises a lower stool body 20, a lower grip 21 and a lower connecting portion 22. Both the upper stool body 10 and the lower stool body 20 are disposed in a circular structure and are the same in diameter. At least part of a lower surface of an outer edge of the upper stool body is extended downward to form an upper stool edge 101, and a stool groove is formed on the upper stool edge. At least part of an upper surface of an outer edge of the lower stool body is extended outward to form a lower stool edge 201. The lower stool edge is just embedded into the stool groove, so that the lower stool edge and the stool groove can be better fitted, and it is convenient to store the telescopic stool in the contracted state. At least part of the surface of the middle portion of the upper stool body 10 is recessed downward form an upper groove portion 13, and the upper grip 11 is just embedded into the upper groove portion 13. In this embodiment, the upper grip 11 and the upper groove portion 13 are buckled with each other. At least part of the surface of the middle portion of the lower stool body 20 is recessed upward to form a lower groove portion 23, and the lower grip 21 is just embedded into the lower groove portion 23. In this embodiment, the lower grip 21 and the lower groove portion 23 are buckled with each other. A plurality of reinforcing ribs is disposed on the upper stool body 10 and the upper surface of the lower stool body 20, and the plurality of reinforcing ribs are disposed in a cobweb structure in order to the structural strength of the upper stool body and the lower stool body.

Figure 3:
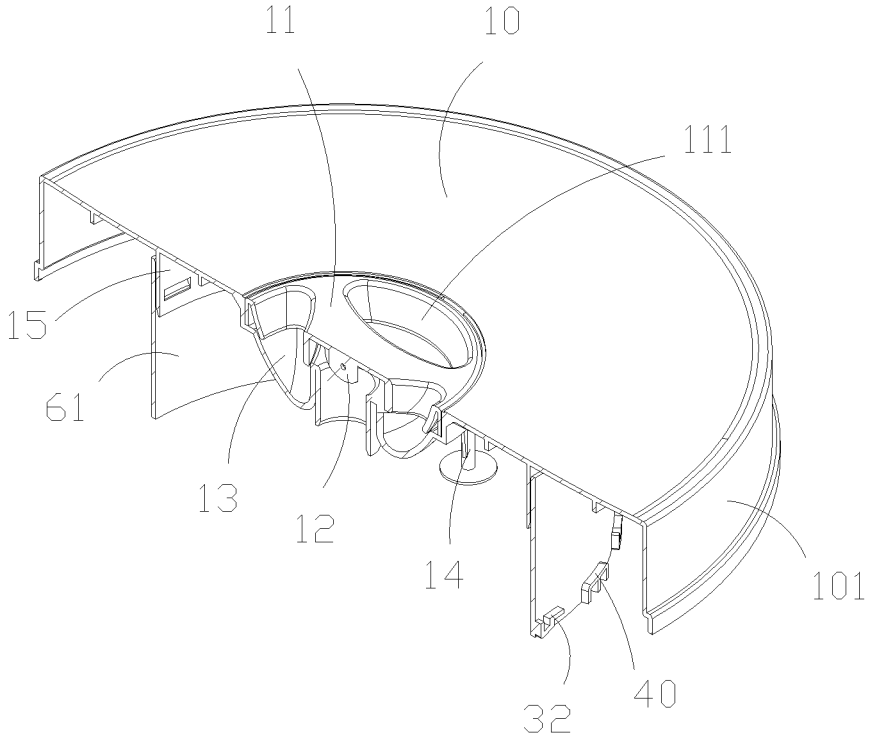
FIG. 3 is a sectional view of the cooperation of a stool surface with a first transition member according to Example 1 of the disclosure.

As shown in FIG. 3, in some embodiments, the upper grip 11 is disposed in a circular structure, three upper through grooves 111 are formed on the upper grip 11, and grooves corresponding to the upper through grooves 111 are formed on the upper groove portion 13, so that it is convenient for a user to grip the stool surface 1. The upper connecting portion 12 is mounted in the middle portion of the lower surface of the upper grip 11, and a through hole is formed on the upper connecting portion 12. The lower grip 21 has the same structure as the upper grip 11. Grooves corresponding to lower through grooves are formed on the lower groove portion. The lower connecting portion is mounted in the middle portion of the upper surface of the lower grip 21, and corresponds to the upper connecting portion and has the same structure as the upper connecting portion. A through hole is also formed on the lower connecting portion. The through holes on the upper and lower connecting portions are connected by two ends of a spring, respectively, to keep the resisted state between the stool surface 1 and the stool base 2. Through holes for allowing the spring to pass therethrough are formed on the upper stool body 10 and the lower stool body 20.

Figure 4:
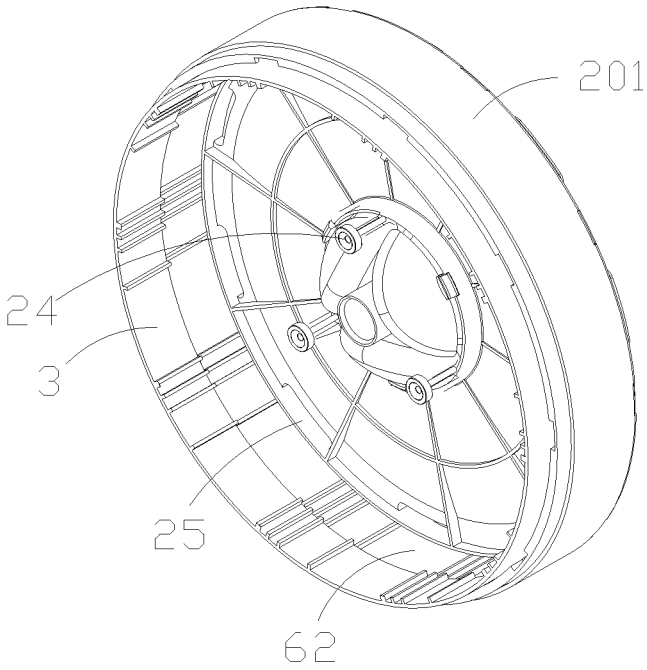
FIG. 4 is a stereoscopically sectional view of a telescopic stool according to Example 1 of the disclosure.
Figure 5:
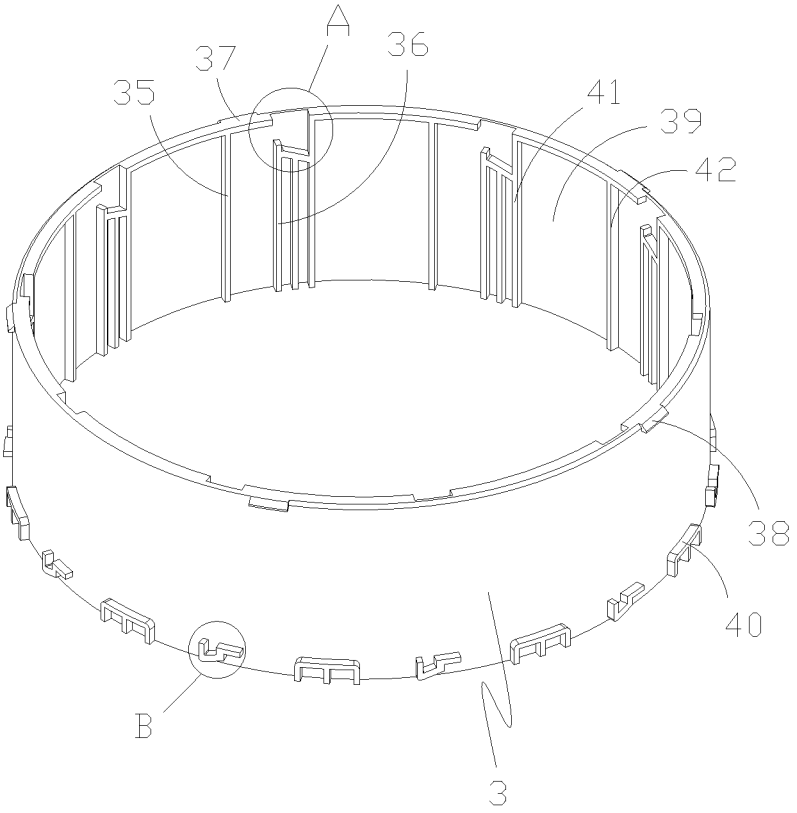
FIG. 5 is a stereoscopic structure diagram of a connecting piece according to Example 1 of the disclosure.

As shown in FIGS. 3 and 4, in some embodiments, an upper support column 14 is further disposed on the upper stool body 10, and a lower support column 24 is further disposed on the lower stool body 20. When the stool surface 1 is resisted against the stool base 2, the upper support column 14 is also resisted against the lower support column, thus improving the support force for the telescopic stool in the contracted state.

Further, a metal block is mounted at a lower end of the upper support column 14, and a magnet is mounted at an upper end of the lower support column 24. Thus, it is further ensured that the stool surface 1 and the stool base 2 can be kept in the contracted state and difficult to accidentally separate from each other.

As shown in FIG. 2, in some embodiments, at least part of the surface of the lower stool surface is extended outward to form stool legs 202. A plurality of stool legs is disposed uniformly in the circumferential direction of the lower stool body 20, and antiskid stripes are formed on the surfaces of the stool legs.

In other embodiments, it is also possible that the stool legs 202 are antiskid blocks mounted on the lower stool body 20, and the antiskid blocks are made of rubber, silicone or other materials. Specifically, at least part of the surface of the lower stool body 20 is recessed inward to form stool leg mounting grooves. The plurality of stool leg mounting grooves are disposed uniformly in the circumferential direction of the lower surface of the lower stool body 20. The stool legs 202 are mounted in the stool leg mounting grooves. Even if the stools legs are worn to a certain extent after long-term use, the stool legs still have good friction and are difficult to slip, thus realizing higher stability and reliability and higher safety.

Preferably, antiskid stripes are formed on the surface of the upper stool body 10.

The upper connecting portion 12, the lower connecting portion 22, the spring, the metal block and the magnet form an anti-escapement mechanism configured to keep the telescopic stool in the contracted state.

As shown in FIG. 3, in some embodiments, the first transition mechanism comprises a first transition member 61 and an upper transition portion 15. The upper transition portion 15 is formed by extending downward at least part of the lower surface of the upper stool body 10, and is disposed in an annular structure. The first transition member 61 is disposed in an annular structure, and a plurality of second limiting portions 32 and a plurality of fourth limiting portions 40 are mounted in the lower portion of the outer surface of the first transition member 61. The second limiting portions and the fourth limiting portions are disposed in a staggered manner, so it is convenient for connection between the first transition member 61 and the connecting pieces 3. A plurality of buckle bumps is formed in the upper portion of the inner surface of the first transition member, and a plurality of buckle grooves are formed on the upper transition portion 15. By cooperating the buckle bumps with the buckle grooves, the buckling connection between the first transition member and the upper transition portion is realized.

As shown in FIG. 4, in some embodiments, the second transition mechanism comprises a second transition member 62 and a lower transition portion 25. The lower transition portion 25 is formed by extending upward at least part of the upper surface of the lower stool body 20, and is disposed in an annular structure. A gap is reserved between a lower stool edge 201 and the lower transition portion, and the second transition member is mounted in the gap. The second transition member 62 is disposed in an annular structure, and the structure of the inner surface of the second transition member 62 is identical to the structure of the inner surfaces of the connecting pieces 3, so it is convenient for the connection between the second limiting portions 32 and the fourth limiting portions 40 on the connecting pieces and the second transition member. The outer surface of the second transition member is a smooth member, a plurality of buckle bumps is formed at the lower end of the second transition member, and a plurality of buckle grooves are formed in the gap. By cooperating the buckle bumps with the buckle grooves, the buckling connection between the second transition member and the lower transition portion is realized.

Example 2

As shown in FIGS. 14-17, this embodiment differs from Embodiment 1 in that: the fixation mechanism further comprises a third limiting structure configured to provide radial limiting for the connecting pieces 3. The third limiting structure comprises fifth limiting portions 323 disposed on the connecting pieces 3 and sixth limiting portions 313 matched with the fifth limiting portions on adjacent connecting pieces 3. The fifth limiting portions are disposed on the bottoms of the second limiting portions 32 and formed by extending downward at least part of the surfaces of outer edges of the second limiting portions 32. The sixth limiting portions are disposed on the first limiting portions 31 and formed by extending upward at least part of the surfaces of the first limiting portions 31 on a side close to the center of the connecting ring. The sixth limiting portions, the inner walls of the connecting pieces and the second rotation stopping portions 312 cooperate with each other to form groove structures on the first limiting portions 31, and the fifth limiting portions can be just embedded into the groove structures. Thus, when the telescopic mechanism is in the extended state, the fifth limiting portions are just embedded into the groove structures on adjacent connecting pieces, so that the connecting pieces are unable to deform radially, two adjacent connecting pieces are stably kept in the extended state and the structure becomes more stable and safer. When it is necessary to contract, the connecting pieces 3 can be normally rotated by pulling the stool surface 1 upward to drive the fifth limiting portions 323 to escape from the groove structures, so that the second limiting portions enter the first movement regions for contraction.

Figure 13:
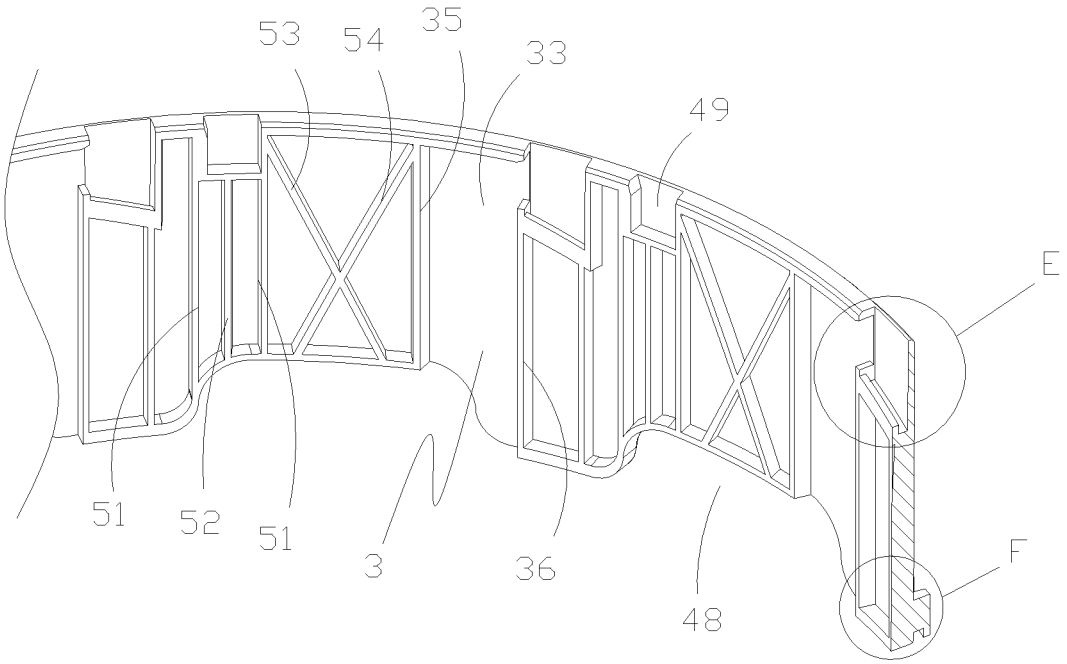
FIG. 13 is a partially stereoscopic structure diagram of a connecting piece according to Example 2 of the disclosure.
Figure 14:
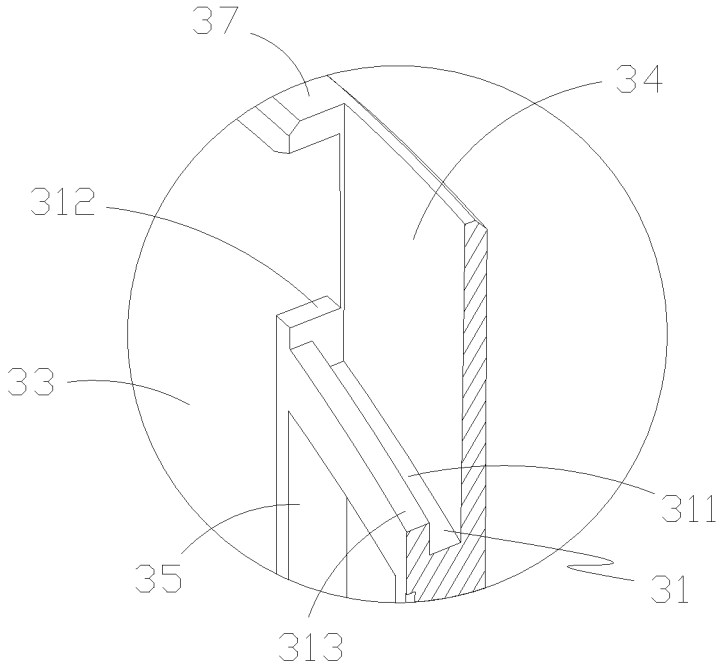
FIG. 14 is an enlarged view of part E in FIG. 13.
Figure 15:
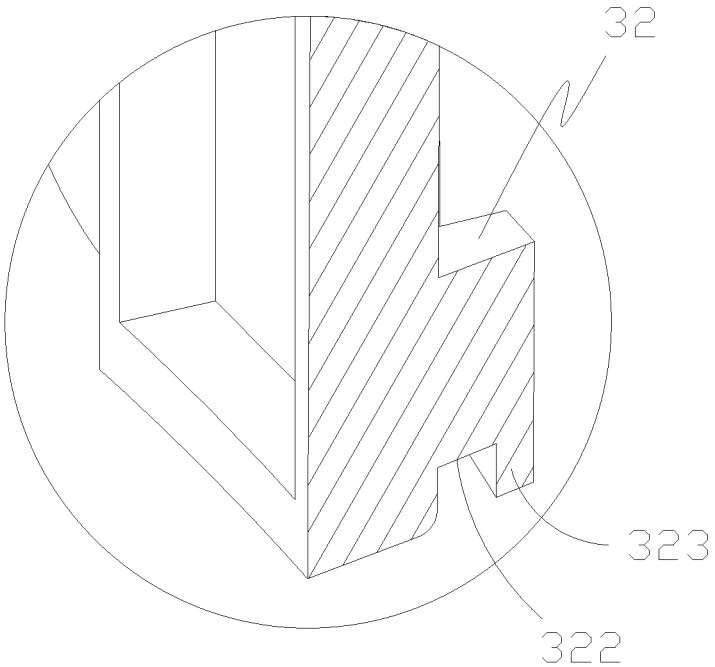
FIG. 15 is an enlarged view of part F in FIG. 13.

As shown in FIG. 13, in some embodiments, a support mechanism for dispersing the stress of the connecting pieces is disposed on the connecting pieces. The support mechanism comprises bearing components for providing a support force and reinforcing components matched with the bearing components. A plurality of bearing components and a plurality of reinforcing components are disposed in a staggered manner. The bearing components comprise a plurality of first bearing members 51 disposed in the inner walls of the connecting pieces and second bearing members 52 matched with the first bearing members. The first bearing members and the second bearing members 52 are formed by extending outward at least parts of the inner walls of the connecting pieces 3, respectively, in order to enhance the axial support capability of the connecting pieces and prevent the connecting pieces from bending and deformation. The reinforcing components comprise third bearing members 53 and fourth bearing members 54 which are crossed with each other. The third bearing members and the fourth bearing members are formed by extending outward at least parts of the inner walls of the connecting pieces 3, respectively. The third bearing members are connected to the first bearing members 51 to realize a joint support effect. Since the third bearing members and the fourth bearing members are crossed with each other, they are able to support each other, thereby reinforcing the connecting pieces 3 and preventing the connecting pieces 3 from circumferential deformation. Thus, the load borne by the stool surface are uniformly distributed on the connecting pieces, so it is convenient to provide a good support effect for the stool surface, and the structural strength is higher. Further, it is possible to lighten and thin the connecting pieces, so the weight of the connecting pieces is reduced, the material is saved, and it is convenient to carry. Thus, the purpose of reducing weight is achieved, it is more convenient for consumers to carry, and it is more practical. Meanwhile, individual connecting pieces have a certain radial deformation capability, so it is convenient for the connection and mounting of the connecting pieces 3, the assembly efficiency is improved, and it is convenient for production.

In other embodiments, it is also possible that the support mechanism is a reinforcing structure in other forms, such as a plurality of inclined reinforcing ribs or a branch structure formed by a plurality of reinforcing ribs, as long as the effect of enhancing the structural strength of the connecting pieces can be achieved, the weight of the connecting pieces can be reduced and convenient assembling can be realized.

Figure 16:
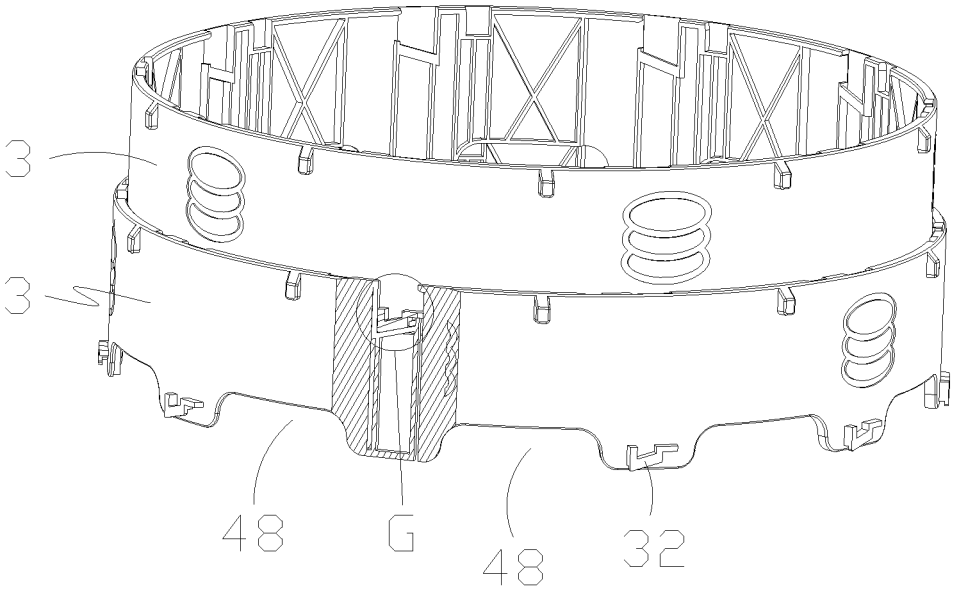
FIG. 16 is a stereoscopic diagram of the cooperation of two connecting pieces when the telescopic stool is extended according to Example 2 of the disclosure.
Figure 17:
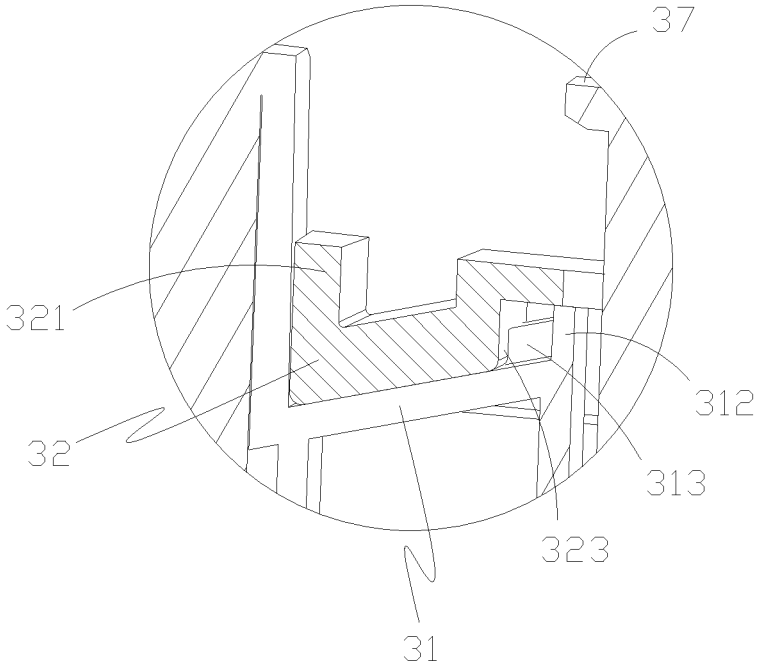
FIG. 17 is an enlarged view of part G in FIG. 16.

As shown in FIGS. 13, 16 and 17, in some embodiments, recesses 48 are further disposed on the connecting pieces 3. The recesses are formed by recessing inward at least parts of the surfaces of lower edges of the connecting pieces. The plurality of recesses is uniformly distributed in the circumferential direction of the connecting pieces, and the plurality of recesses and the plurality of second limiting portions 32 are disposed in a staggered manner. By providing third grooves, the weight of individual connecting pieces is further reduced without hindering the connection between adjacent connecting pieces, and the purpose of lightening the telescopic stool is achieved. Moreover, when the fifth limiting portions 323 cooperate with the sixth limiting portions 313 to fix the telescopic mechanism in the extended state, it is unable to observe the recesses 48 from the outside of the extended telescopic mechanism. When it is able to observe the recesses 48, it indicates that the fifth limiting portions are not completely embedded into the groove structures formed by cooperation of the sixth limiting portions, the inner walls of the connecting pieces and the second rotation stopping portions 312. Thus, the effect of reminding the user to adjust the telescopic mechanism is achieved, the connecting pieces are prevented from damage due to unbalanced stress, the safety of the telescopic stool when in use is improved, and the service life is prolonged.

In other embodiments, it is also possible that the recesses 48 are recesses or through grooves formed near the lower portions of the connecting pieces 3.

Figure 18:
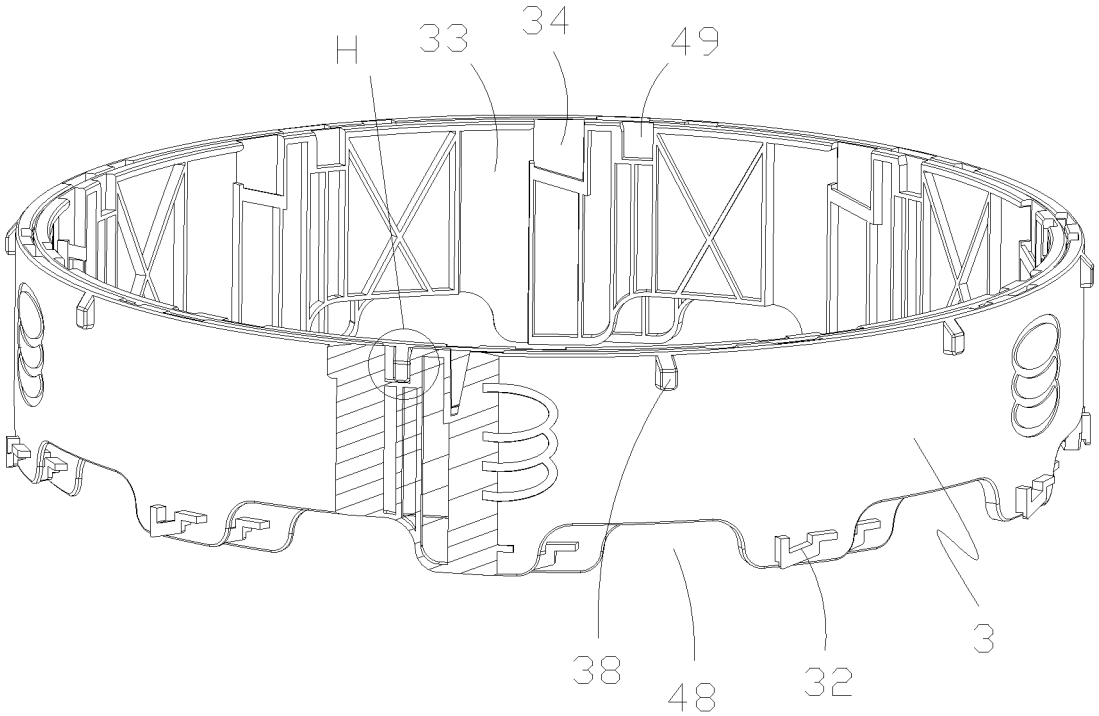
FIG. 18 is a stereoscopic diagram of the cooperation of two connecting pieces when the telescopic stool is contracted according to Example 2 of the disclosure.
Figure 19:
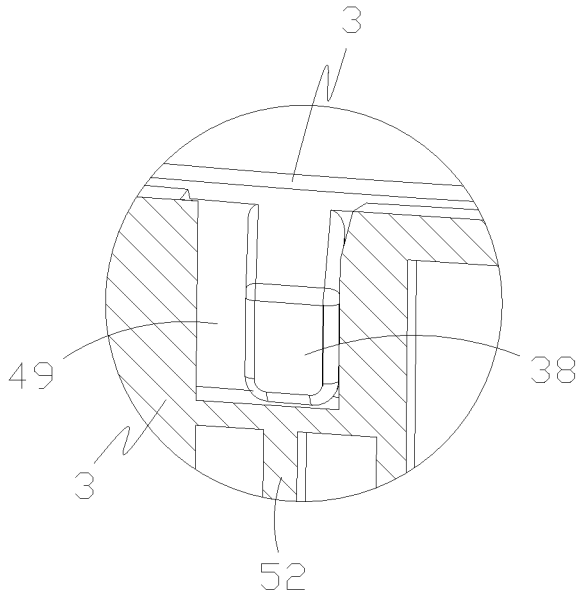
FIG. 19 is an enlarged view of part H in FIG. 18.

As shown in FIGS. 18-19, in some embodiments, the cross-sections of the third limiting portions 38 are still of a trapezoidal structure, and the plurality of third limiting portions 38 are disposed uniformly in the circumferential direction of the connecting pieces 3. However, since the circumferential length is less than the axial length, the third limiting portions 38 is reduced in overall size and further lightened. Seventh limiting portions 49 are disposed on the connecting pieces 3. When the telescopic mechanism is in the contracted state, at least part of the third limiting portion 38 on the connecting piece 3 on a side close to the stool surface 1 is located in the seventh limiting portion 49 on another adjacent connecting piece 3 on a side close to the stool base 2, so that the previous connecting piece 3 will not fall out of the lower connecting piece, and the stability of connection between two adjacent connecting pieces is maintained. Meanwhile, the upper surfaces of the connecting pieces 3 are flush with each other, so the telescopic mechanism can be better contracted, smaller in size and convenient to carry.

Figure 20:
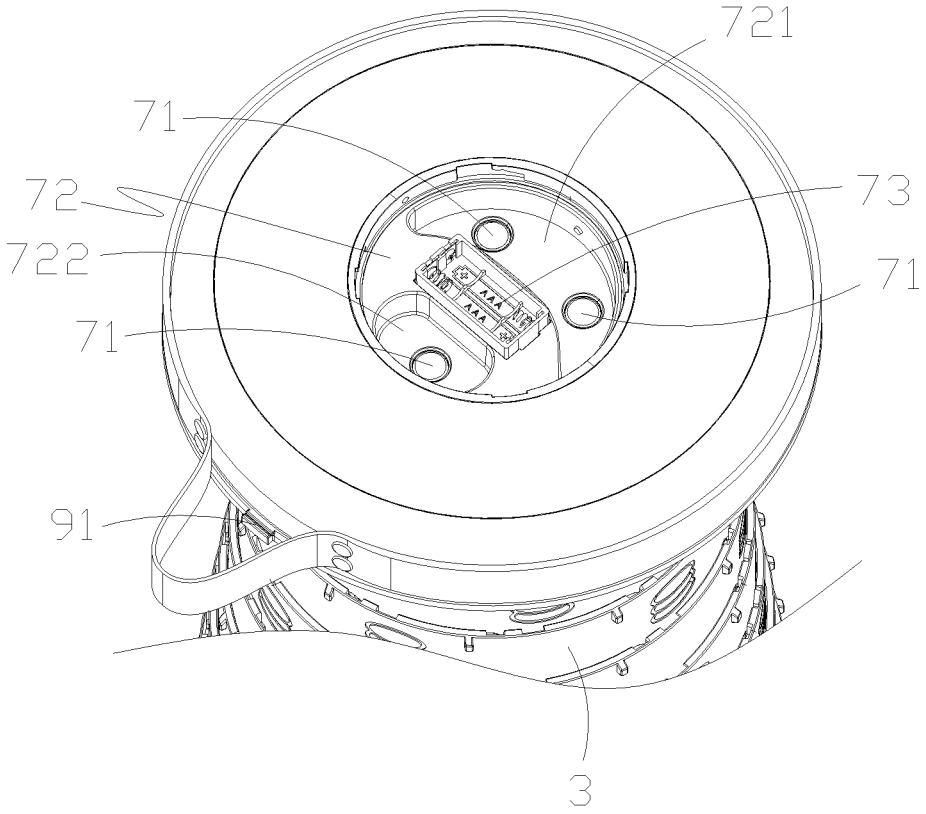
FIG. 20 is a partially stereoscopic sectional view of a telescopic stool according to Example 2 of the disclosure.
Figure 21:
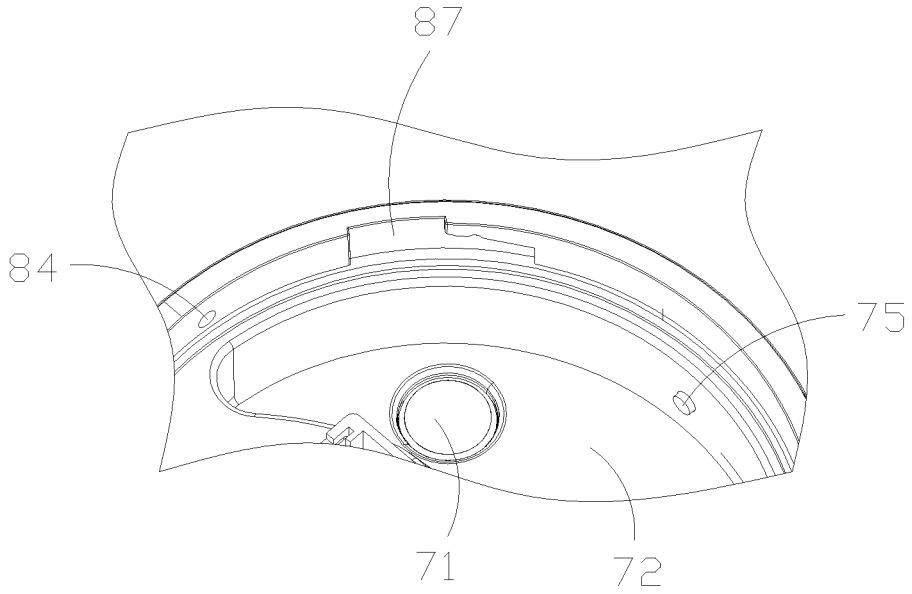
FIG. 21 is a partially enlarged view of FIG. 20.
Figure 22:
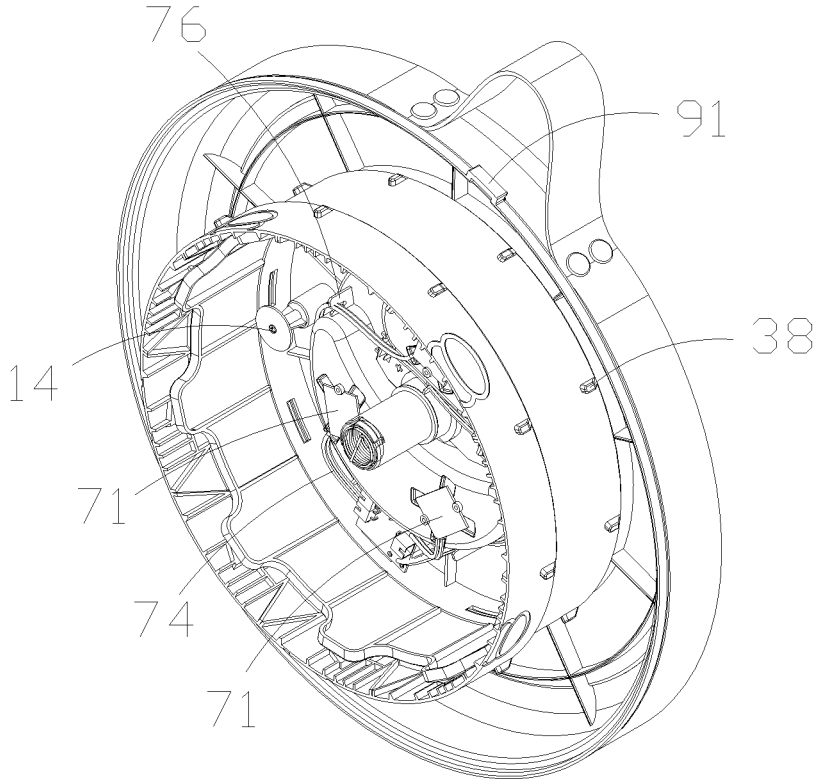
FIG. 22 is a transversely stereoscopic sectional view according to Example 2 of the disclosure.

As shown in FIGS. 20-22, in some embodiments, a luminous mechanism is further provided. The luminous mechanism comprises luminous bodies 71 for generating light, a power supply component for providing power to the luminous bodies 71, a mounting portion 72 for loading the power supply component and a seal cover structure detachably connected to the mounting portion. The luminous bodies are LED lamps. In other embodiments, the luminous bodies are other light sources. The power supply component comprises a mounting base 73 disposed in the mounting portion 72, an energy source member disposed on the mounting base and a connecting wire 74 for connecting the mounting base to the luminous bodies. The energy source member is a battery. In other embodiments, it is also possible that the energy source member is a power supply element such as an electrical plate. The connecting wire is an electric wire for connecting the mounting base to the luminous bodies. The mounting base is a battery holder for mounting the battery. The battery holder is an existing structure and will not be repeated here. In this embodiment, the battery holder is detachably connected to the stool surface 1 by buckles and clamping slots. In other embodiments, it is also possible that the battery holder is directly fixedly connected within the mounting portion or connected by screws. A take-up member 76 for taking up the connecting wire 74 is further mounted on the stool surface 1.

Further, in this embodiment, the mounting portion 72 is a groove body structure formed by recessing downward at least part of the surface of the stool surface 1, comprising a big groove 721 and a small groove 722. In other embodiments, it is also possible that the mounting portion is a mounting column or other structures as long as the mounting portion is able to be used for mounting the luminous bodies and the energy source component.

As shown in FIGS. 20-21, in some embodiments, a switch 75 for controlling the operating state of the luminous bodies is disposed on the mounting portion 72. The switch is mounted on a sidewall of the big groove 721, so that it is ensured that it is convenient to use the switch, and it is difficult to touch the switch by mistake. In other embodiments, a switch sleeve is sleeved on the switch 75. It is possible that the switch sleeve is made of a rubber material, a silicone material or other materials, thereby increasing the hand feeling and achieve the insulating, anti-skidding, buffering and collision avoiding effects.

Figure 12:
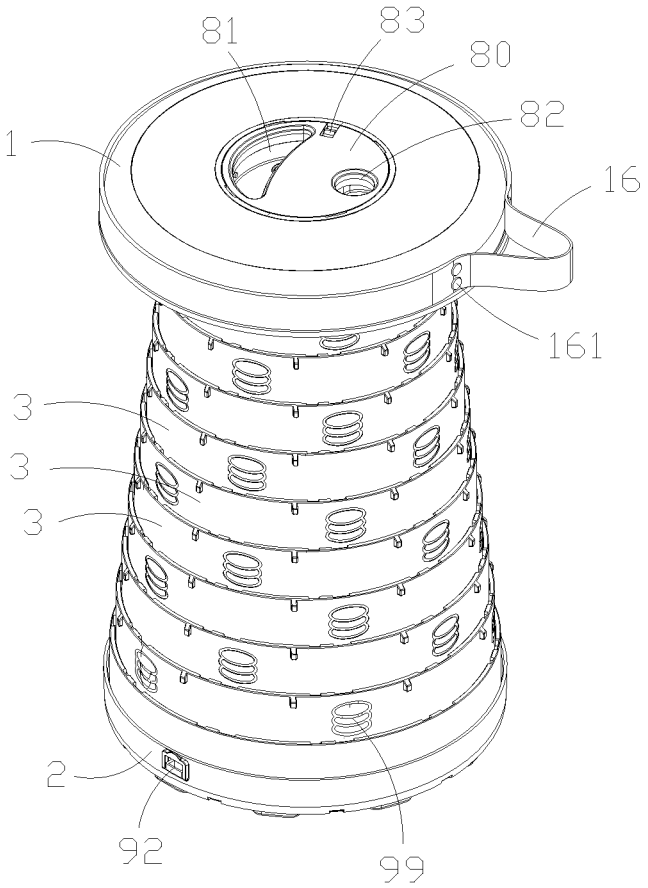
FIG. 12 is a stereoscopic structure diagram of a telescopic stool in an extended state according to Example 2 of the disclosure.

As shown in FIGS. 12 and 20, in some embodiments, the seal cover structure comprises a cover plate 80 and a locking structure. A first cover plate groove 81 and a second cover plate groove 82 are formed on the cover plate. The cover plate is used for sealing the mounting portion 72 and disposed in a circular structure. The first cover plate groove 81 is an arc-shaped groove formed on the cover plate and corresponds to the big groove 721, so that it is convenient for the user to place four fingers. The second cover plate groove 82 is a circular groove formed on the cover plate and corresponds to the small groove 722, so that it is convenient for the user to place the thumb, and it is convenient for the user to grip the stool surface 1. A structure the same as the cover plate is disposed on the stool base 2 for gripping.

Figure 24:
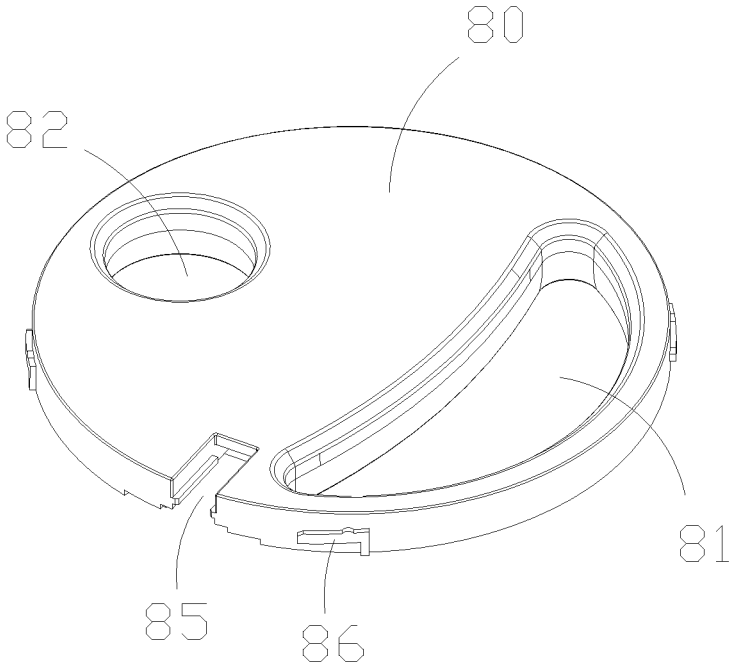
FIG. 24 is a stereoscopic structure diagram of a cover plate according to Example 2 of the disclosure.

As shown in FIGS. 13, 21 and 24, in some embodiments, the locking structure is used for realizing the detachable connection between the mounting portion and the cover plate. The locking structure comprises a clamping member 83 disposed on the cover plate 80, a bayonet 84 matched with the clamping member and a mounting groove 85 matched with the clamping member. The mounting groove is formed on the cover plate 80, the clamping member 83 is mounted in the mounting groove, and the mounting groove and the clamping member are in slid fit with each other. A buckle is disposed on the inner wall of the mounting portion 72, and the clamping member is able to be clamped into the bayonet to realize the locking of the cover plate and the mounting portion. A locking bump 86 is further disposed on the sidewall of the cover plate, and a locking groove 87 is formed on the sidewall of the mounting portion. The locking groove is an L-shaped structure. The locking bump is fitted with the locking groove, so it is convenient to realize the connection between the cover plate and the mounting portion.

Figure 23:
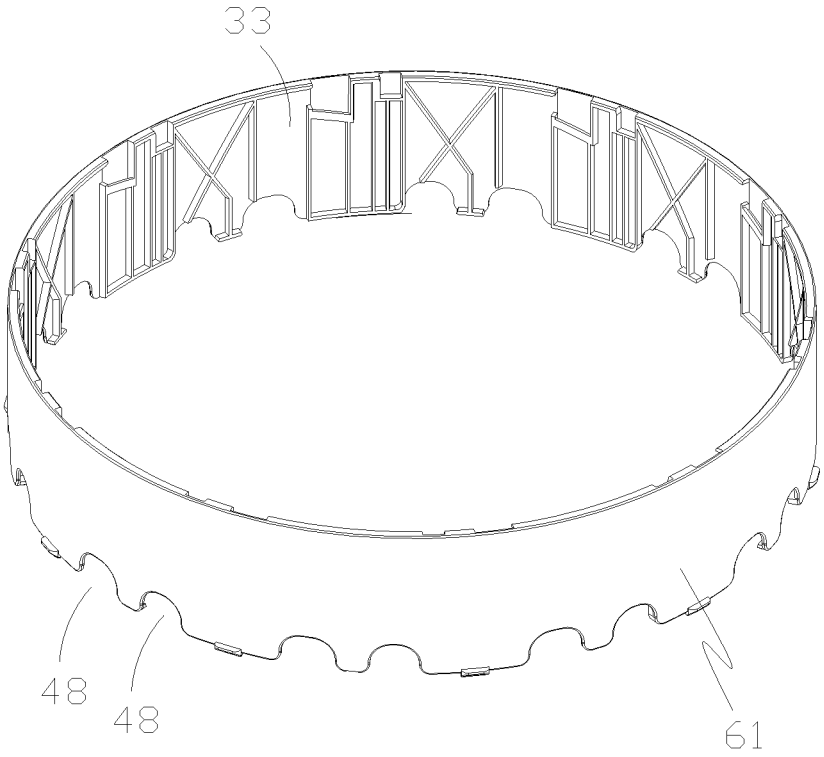
FIG. 23 is a stereoscopic structure diagram of a first transition member according to Example 2 of the disclosure.

As shown in FIGS. 22 and 23, in some embodiments, third limiting portions 38 are further mounted on the first transition member 61, and reinforcing ribs are mounted on the inner surface of the first transition member 61. The structure of the inner surface of the second transition member 62 is basically the same as the structures of the inner surfaces of the connecting pieces in this embodiment, with the outer surface being smooth, a buckle being formed only on the bottom, and two parallel recesses 48 being formed on the bottom.

As shown in FIGS. 12 and 20, in some embodiments, an anti-escapement mechanism configured to keep the telescopic stool in the contracted state is further provided. The anti-escapement mechanism comprises a fixation component for interlocking the stool surface 1 and the stool base 2. The fixation component comprises a first anti-escapement portion 91 disposed on the stool surface 1 and a second anti-escapement portion 92 matched with the first anti-escapement portion. The second anti-escapement portion is a buckle rotatably connected to stool base, and the anti-escapement portion is an annular bump. After the stool surface is pressed onto the stool base, the buckle is turned up, and the buckle is buckled on the annular bump. By cooperating the buckle with the annular bump, it cooperates with the third anti-escapement portion to fix the stool surface. The stool surface is fixed on the stool base, so that the telescopic stool is prevent from relaxation during transportation.

Figure 25:
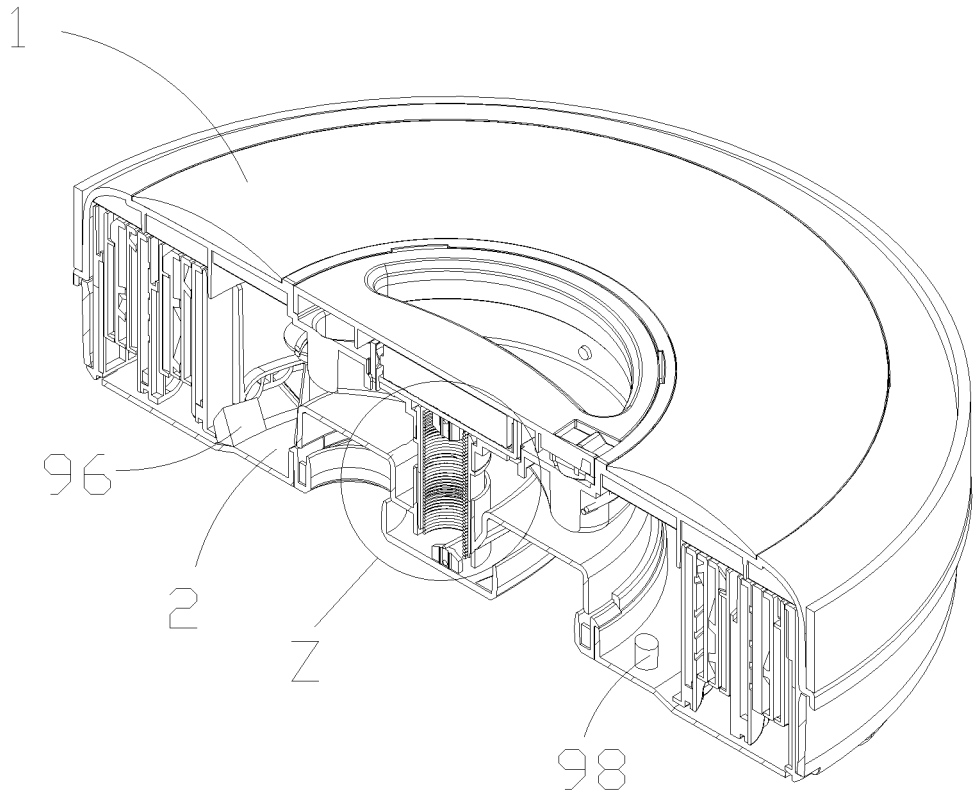
FIG. 25 is a longitudinally stereoscopic sectional view of a telescopic stool according to Example 2 of the disclosure.
Figure 26:
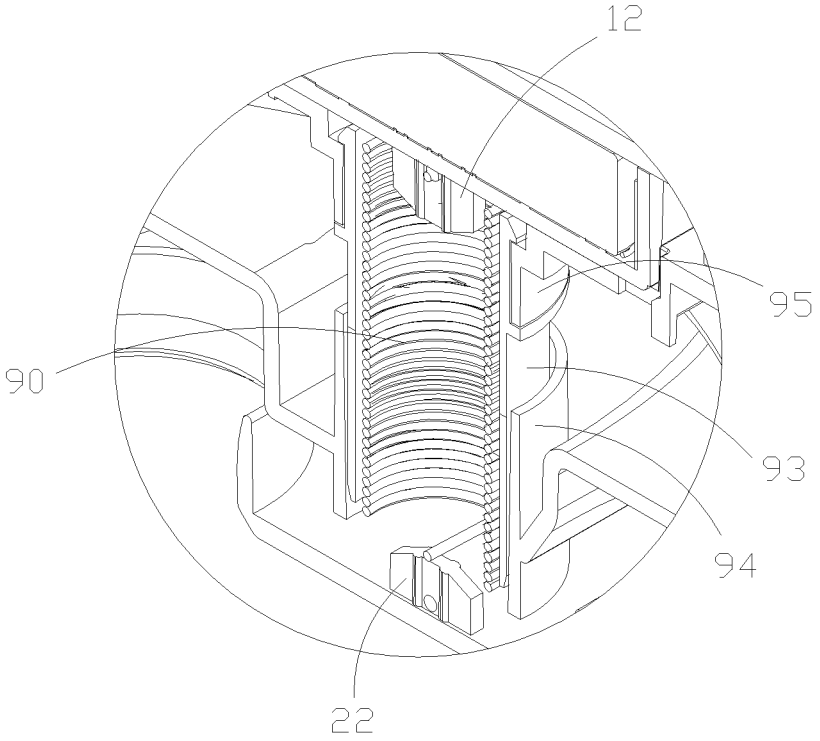
FIG. 26 is an enlarged view of part Z in FIG. 25.
Figure 27:
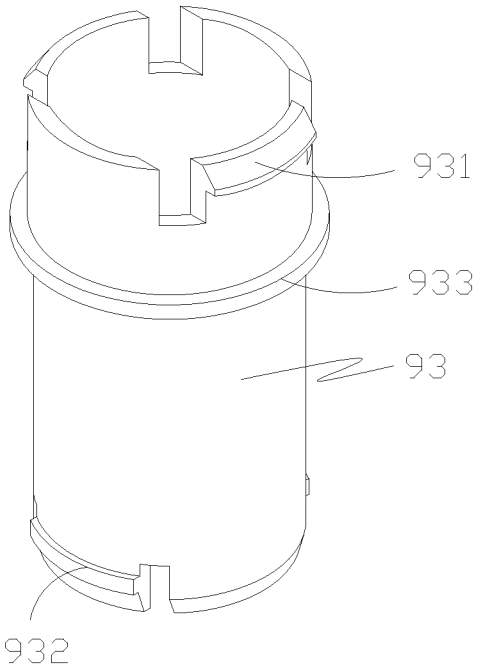
FIG. 27 is a stereoscopic structure diagram of a third anti-escapement member according to Example 2 of the disclosure.

As shown in FIGS. 25-27, in some embodiments, the anti-escapement mechanism further comprises an anti-escapement component for preventing the stool surface 1 and the stool base 2 from moving away from each other. The anti-escapement component comprises a third anti-escapement portion 93 disposed on the stool surface and a fourth anti-escapement portion 94 matched with the third anti-escapement portion. A fifth anti-escapement portion 95 is further disposed on the stool surface 1. The third anti-escapement portion 93 is of a barrel structure. A first buckle portion 931 for buckling with the fifth anti-escapement portion is disposed on the top of the third anti-escapement portion, and a limiting ring 933 matched with the fifth anti-escapement portion. The fourth anti-escapement portion 94 for fixing the third anti-escapement portion is disposed on the stool base. The fourth anti-escapement portion is of a tube structure. When the telescopic stool is contracted, the stool surface is covered on the stool base, the bottom of the third anti-escapement portion 93 is inserted into the fourth anti-escapement portion, and the second buckle portion 932 on the bottom of the third anti-escapement portion is in interference fit with the fourth anti-escapement portion, so that the friction between the third anti-escapement portion and the fourth anti-escapement portion is increased, and the contracted state of the telescopic stool is maintained. Grooves are formed on both the bottom and top of the third anti-escapement portion, so that it is convenient for the deformation of the third anti-escapement portion when it cooperates with the fifth anti-escapement portion and the fourth anti-escapement portion.

In other embodiments, it is possible to replace the structures of the third anti-escapement portion and the fourth anti-escapement portion with other structures, such as an insertion rod and an insertion bushing. The anti-escapement effect between the insertion rod and the insertion bushing is realized by increasing friction. For example, rubber is mounted on the outer wall of the insertion rod and the inner wall of the insertion bushing. Of course, a magnet is also possible. The anti-escapement effect between the stool surface and the stool base is realized by the attraction force of the magnet.

Preferably, the upper connecting portion 12 on the stool surface 1 is connected to the lower connecting portion 22 on the stool base 2 via a resetting member 90. The resetting member is a spring. In other embodiments, it is also possible that the resetting member is made of other elastic materials.

Further, the anti-escapement mechanism further comprises a limiting structure for preventing movement of the connecting pieces 3. The limiting structure is a sixth anti-escapement portion 96 disposed on the stool base. The sixth anti-escapement portion is similar to a buckle structure, and is able to cooperate with the first transition member 62 so as to lock the first transition member so that the first transition member is unable to move when the telescopic stool is contracted. An inclined plane is disposed on the sixth anti-escapement portion, so that at least part of the cross-section of the sixth anti-escapement portion is triangular, and it is convenient to be buckled with or separated from the lower edge of the first transition member.

In other embodiments, it is possible that the sixth anti-escapement portion is other structures capable of connecting the connecting pieces, such as a telescopic rod that is telescoped by a spring, and a clamping slot matched with the telescopic rod.

As shown in FIG. 12, in some embodiments, a portable member 16 is disposed on the sidewall of the stool surface. The portable member is made of one or more of ribbon, nylon and carbon fiber. It is also possible that the portable member is made of other materials. The portable member is fixed to the sidewall of the stool surface by a third fixation member 161, which is a screw. The ribbon is removed to form a handle shape on the sidewall of the stool surface. In other embodiments, it is possible that the portable member is a handle or other structures. It is also possible that the portable member is a telescopic ribbon structure. When the telescopic stool is not in use, the telescopic stool is contracted, and the portable member is held, so that the whole telescopic stool is directly carried. In other embodiments, it is also possible that the third fixation member is hook and loop fasteners.

In other embodiments, it is possible to adjust the length of the portable member 16 by an adjustable buckle, so as to adapt to different application situations. The ends of the portable member are fixed by hook and loop fasteners. Preferably, the adjustable buckle is arc-shaped as a whole, and is fitted with the sidewall of the stool surface.

As shown in FIGS. 12 and 20, in some embodiments, a light transmitting region for allowing light to be transmitted therethrough is further provided. The light transmitting region is a hollow structure formed on one or more of the stool surface, the stool base and the connecting pieces. It is possible that the hollow structure is an opening or through groove, such as the mounting portion 72, the first cover plate groove 81 and the second cover plate groove 82 in this embodiment. When the luminous bodies are disposed facing the stool surface, light is transmitted out from the mounting portion 72, the first cover plate groove 81 and the second cover plate groove 82 on the stool surface.

In this embodiment, there are total three luminous bodies, which are able to emit light in three colors, i.e., white, red and blue. The white light is used for illumination, and the red light and the blue light are able to play a warning role by blinking alternately.

As shown in FIG. 12, in some embodiments, it is possible that the light transmitting region is a groove structure 99 with a small wall thickness, so that light is transmitted out from the bottom wall of the groove and the light transmitting function is realized. By manufacturing the groove structures formed on the connecting pieces 3 into a product logo pattern, the purpose of advertising the product is achieved. In this case, the luminous bodies are disposed in such a manner light will be easily transmitted out from the LOGO pattern when the light is irradiated light from the stool surface to the stool base or from the stool base to the stool surface, so that the pattern is highlighted, better display effect is achieved and it is more beautiful. Of course, it is also possible to form the LOGO pattern into the hollow structure, i.e., through groove. The light is irradiated onto the ground after transmitting the hollow structure, playing a role of an atmosphere lamp.

In other embodiments, it is also possible that the luminous bodies are disposed on the inner walls of the connecting pieces and on the stool base and suspended on the bottom of the stool surface. It is possible that the luminous bodies are uniformly disposed on the sidewall of the stool surface and uniformly distributed on the sidewall of the stool surface in the circumferential direction, so that the user is able to achieve better experience when observing in any direction. When the luminous bodies are disposed on the connecting pieces, it is possible that the luminous bodies and light transmitting regions are disposed in a staggered manner, ensuring the mounting stability of the luminous bodies.

In other embodiments, the luminous bodies are disposed in such a manner that emitted light is irradiated from the stool surface to the stool base, and the connecting pieces 3 are made of a transparent material so that light is able to be transmitted directly.

Light reflecting regions are disposed on the top of the stool surface and the sidewall of the stool surface. It is possible that the light reflecting regions are formed by coating light reflecting coatings or directly pasting a light reflecting sticker. In other embodiments, it is also possible to form the light reflecting regions in other ways. By providing the light reflecting regions, the telescopic stool is able to reflect bright light even in an environment with good light, the highlighting performance of the telescopic stool is increased, the telescopic stool is able to attract more attention of consumers, and it is beneficial to increase the sales volume of the telescopic stool.

Preferably, it is also possible that a light reflecting region is disposed on the portable member 16, so that light can be reflected by the light reflecting region when irradiated onto the portable member, and the warning function is realized. For example, when an automobile suddenly breaks down outdoors or on a road, it is possible to use the telescopic stool of the disclosure to replace a warning sign.

In this embodiment, the light reflecting region is distributed over the outer surface of the portable member 16.

In other embodiments, it is also possible that the light reflecting region is only located on part of the surface of the portable member 16.

In other embodiments, the light reflecting region is a light reflecting tape, and the light reflecting tape is directly woven with the portable member 16, so that the light reflecting tape and the portable member form an integral whole and it is difficult to fall off or damage.

As shown in FIG. 25, in some embodiments, the telescopic stool further comprises an extended structure 98. It is possible that the extended structure is one or more of a buzzer, a sound box, a wireless charging component, a photovoltaic charging component and the like. It is possible that the sound box and the buzzer are mounted on the stool base, in order to provide a large sound conduction space for the sound box and reduce the vibration influence of sound transmission on the stool surface. It is possible that the wireless charging component is mounted on the bottom of the stool surface, in order to shorten the distance from a mobile phone and the wireless charging component and facilitate quick charging of the mobile phone. A plug is disposed on the stool base, and power is provided to the extended structure on the telescopic stool by using the plug on the stool base. It is also possible to mount a photovoltaic charging component to charge the buzzer, the sound box and the like. It is possible that the sound box is a Bluetooth sound box or an ordinary sound box. A connecting wire connected to the sound box is disposed on the stool base. The buzzer, the sound box, the wireless charging component and the photovoltaic charging component all belong to the related art and can be mounted on the telescopic scope of the disclosure only by changing appearance as required, and thus will not be repeated here.

Figure 28:
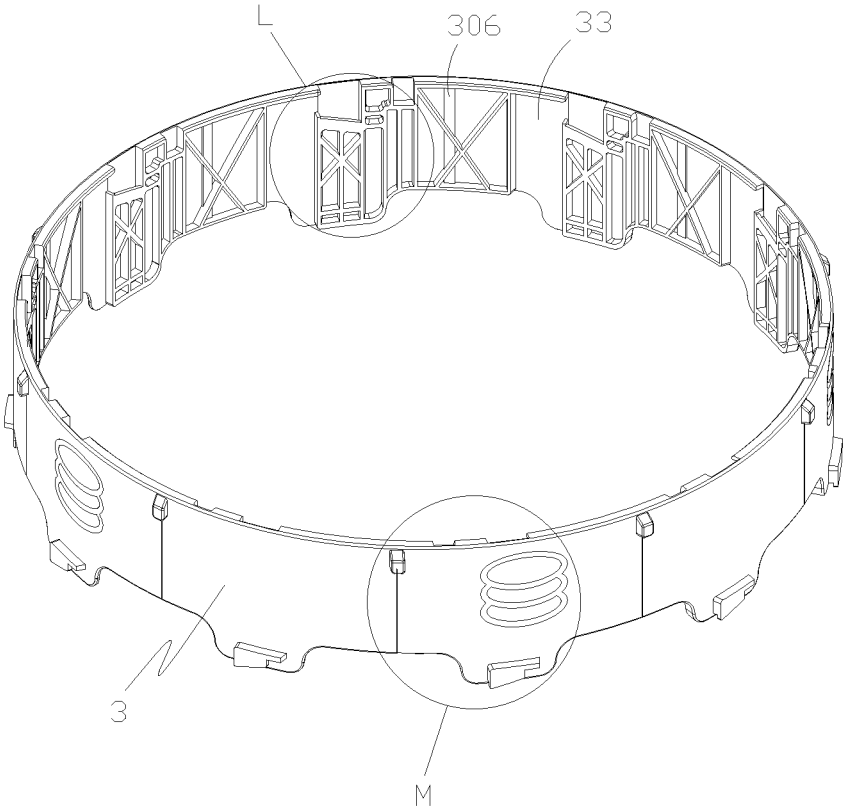
FIG. 28 is a stereoscopic structure diagram of another implementation of the connecting piece according to Example 3 of the disclosure.
Figure 29:
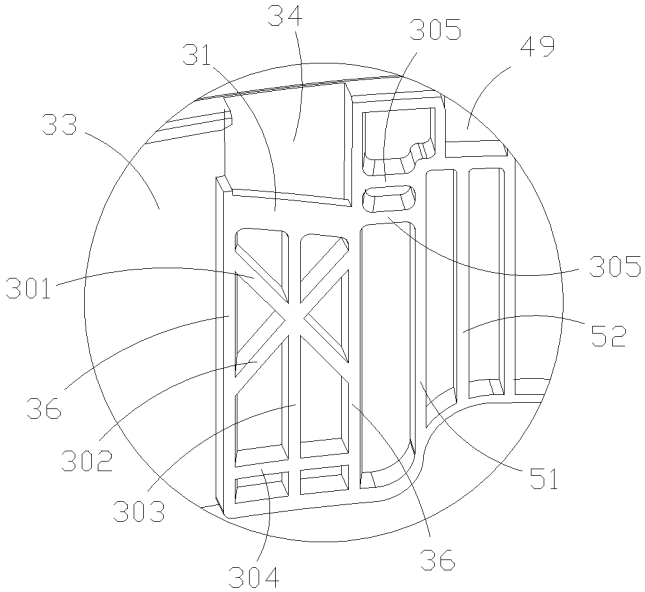
FIG. 29 is an enlarged view of part L in FIG. 28.
Figure 40:
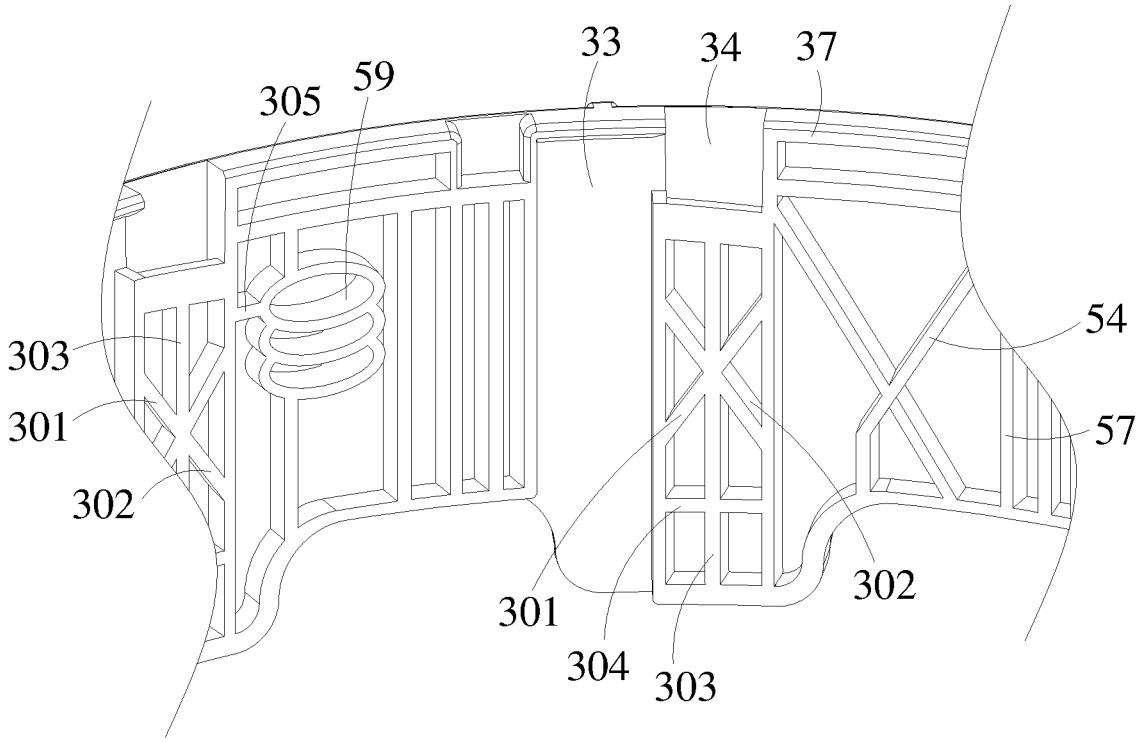
FIG. 40 is a partially stereoscopic structure diagram of another implementation of the connecting piece according to Example 3 of the disclosure.

As shown in FIGS. 28-29 and 40, in some embodiments, a convex rib structure is further disposed on the inner surface of each of the connecting piece 3. The convex rib structure comprises a first convex rib 301, a second convex rib 302, a third convex rib 303, a fourth convex rib 304 and a fifth convex rib 305. Two second projections 36 are formed below the first limiting portion 31, and the two second projections 36 are located on two sides of the first limiting portion 31, respectively. The first convex rib 301 is disposed obliquely, and two ends of the first convex rib are connected to the two second projections 36, respectively. The second convex rib 302 is disposed obliquely, and two ends of the second convex rib are connected to the two second projections 36, respectively. One end of the third convex rib 303 is connected to the first limiting portion 31 vertically and is parallel to the second projections 36. The first convex rib, the second convex rib and the third convex rib are crossed with each other to form a star-shaped structure. The fourth convex rib 304 is disposed horizontally, two ends of the fourth convex rib are connected to the two second projections 36, respectively, and the fourth convex rib 304 is crossed with the third convex rib 303 to form a cross-shaped structure. One end of each of the fifth convex ribs 305 is connected to one of the second projections 36, while the other end thereof is connected to the first bearing member 51. In this embodiment, there are total two fifth convex ribs. In other embodiments, it also possible to form any number of convex ribs.

Figure 30:
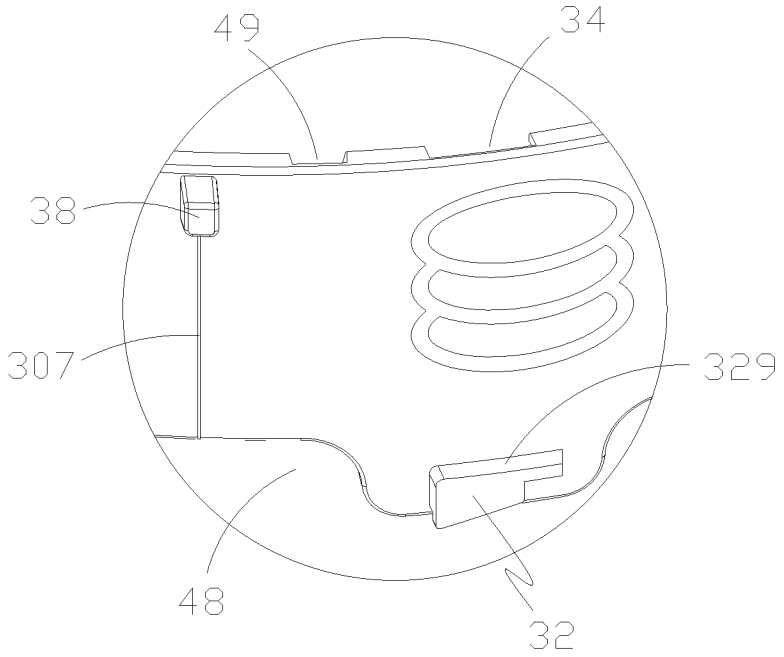
FIG. 30 is an enlarged view of part M in FIG. 28.

As shown in FIG. 30, in some embodiments, artistic lines 307 are formed on the outer surfaces of the connecting pieces 3. The plurality of artistic lines is uniformly disposed in the circumferential direction of the connecting pieces 3, and are in one-to-one correspondence to the third limiting portions 38. The artistic lines are grooves formed in the axial direction of the connecting pieces. Thus, it is convenient for demoulding, and it is more beautiful.

As shown in FIG. 28, in some embodiments, six convex ribs 306 are formed on the inner surfaces of the connecting pieces 3. The plurality of six convex ribs are uniformly disposed in the circumferential direction of the connecting pieces 3, and the plurality of six convex ribs are in one-to-one correspondence to the plurality of artistic lines 307. Thus, the structural strength is enhanced.

As shown in FIG. 30, in some embodiments, it is also possible to form a limiting plane 329 on the upper surface of the second limiting portion 32, so that the second limiting portion is prevented from deformation or breakage, and the structural strength is enhanced without increasing excessive weight.

Example 3

As shown in FIGS. 31-39, this embodiment differs from Embodiment 2 in that: the support mechanism further comprises reinforcing components for providing radial supporting. The reinforcing components comprise fifth bearing members 55 connected to the first bearing members 51, sixth bearing members 56 matched with the fifth bearing members 55, and seventh bearing members 57 matched with the sixth bearing members. The fifth bearing members, the sixth bearing members and the seventh bearing members 57 are formed by extending outward at least parts of the inner walls of the connecting pieces 3, respectively. One ends of the fifth bearing members are connected to the first bearing members 51, while the other ends thereof are connected to the first projections 35. One ends of the sixth bearing members 56 are connected to the fifth bearing members 55, while the other ends thereof are connected to the third projections 37. The first bearing members, the fifth bearing members, the sixth bearing members and the third projections form grooves. One ends of the seventh bearing members 57 are connected to the fifth bearing members 55, while the other ends thereof are connected to seventh projections 47 formed on the lower ends of the inner walls of the connecting pieces 3. One ends of the third bearing members 53 are connected to one ends of the fifth bearing members 55, one ends of the fourth bearing members are connected to one ends of the seventh bearing members, and one ends of the fourth bearing members 54 are bent to form bearing legs 541. The bearing legs are disposed in the axial direction of the connecting pieces and connected to the seventh projections 47 to further enhance the structural strength.

Figure 33:
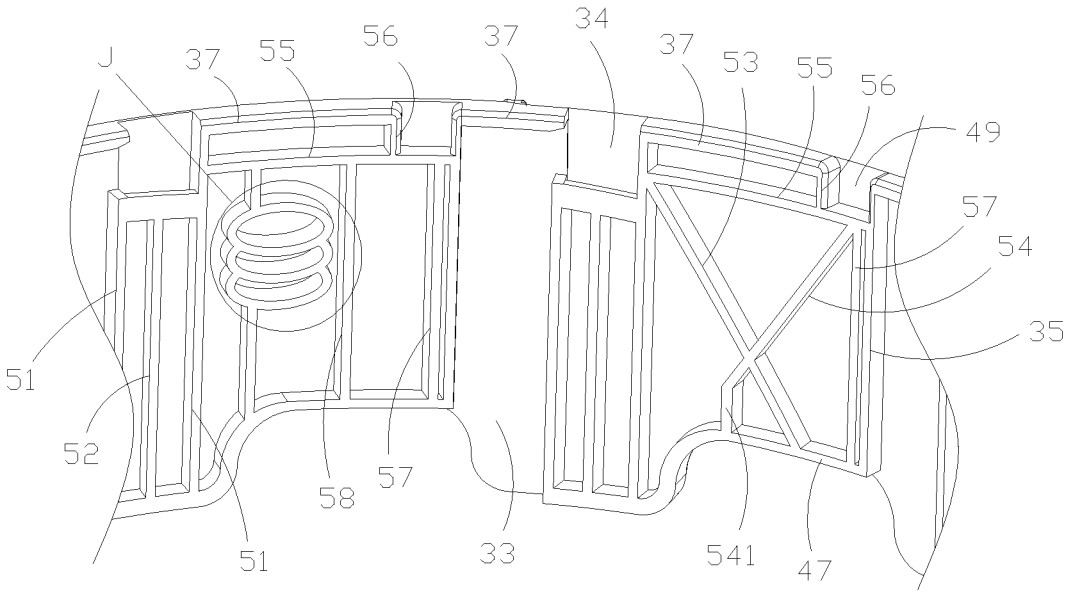
FIG. 33 is a partially stereoscopic structure diagram of the connecting piece according to Example 3 of the disclosure.
Figure 34:
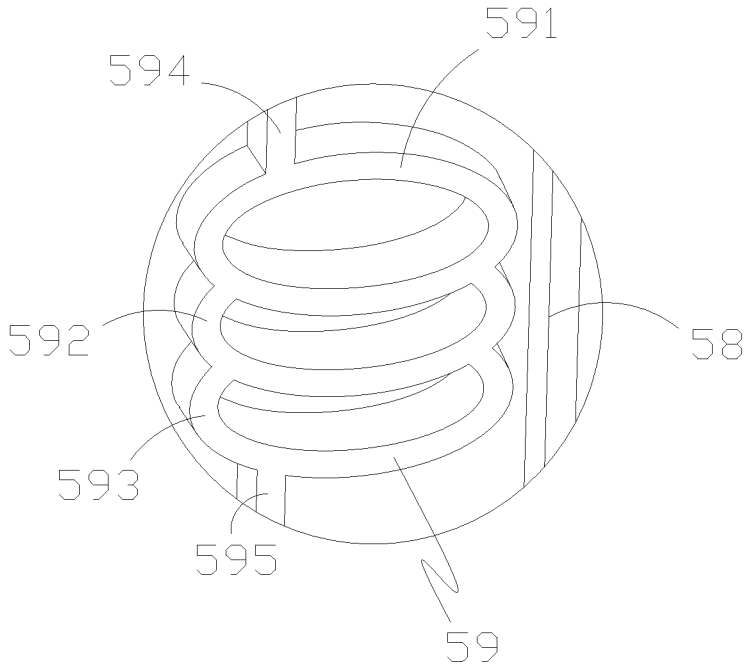
FIG. 34 is an enlarged view of part J in FIG. 33.
Figure 35:
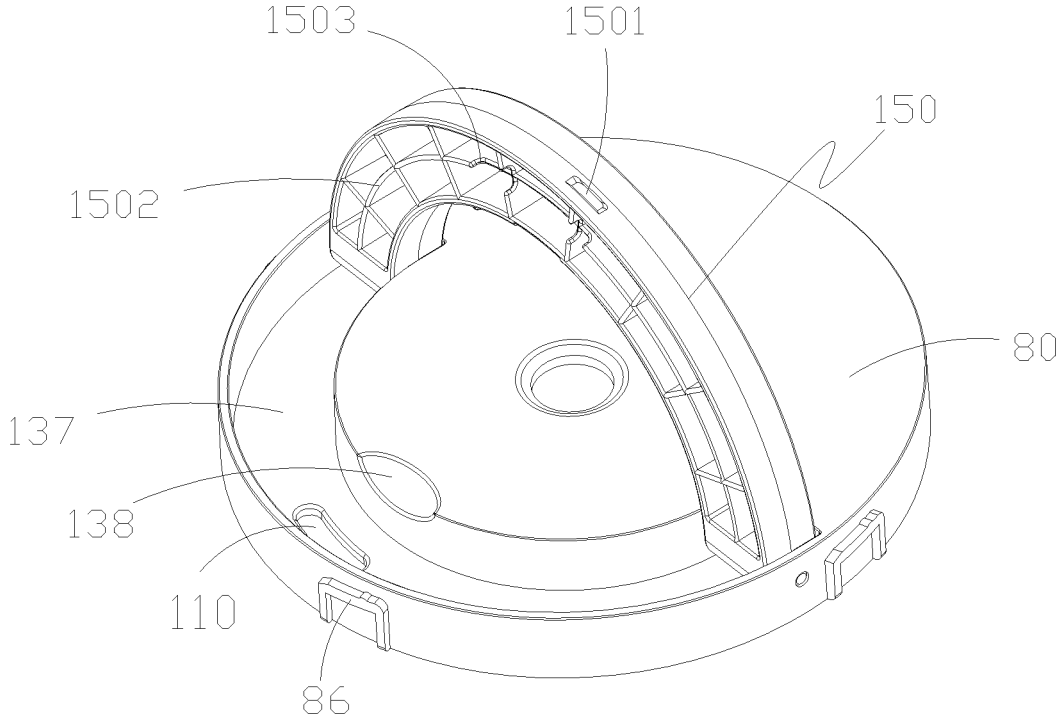
FIG. 35 is a stereoscopic structure diagram of the cover plate from a first perspective according to Example 3 of the disclosure.
Figure 36:
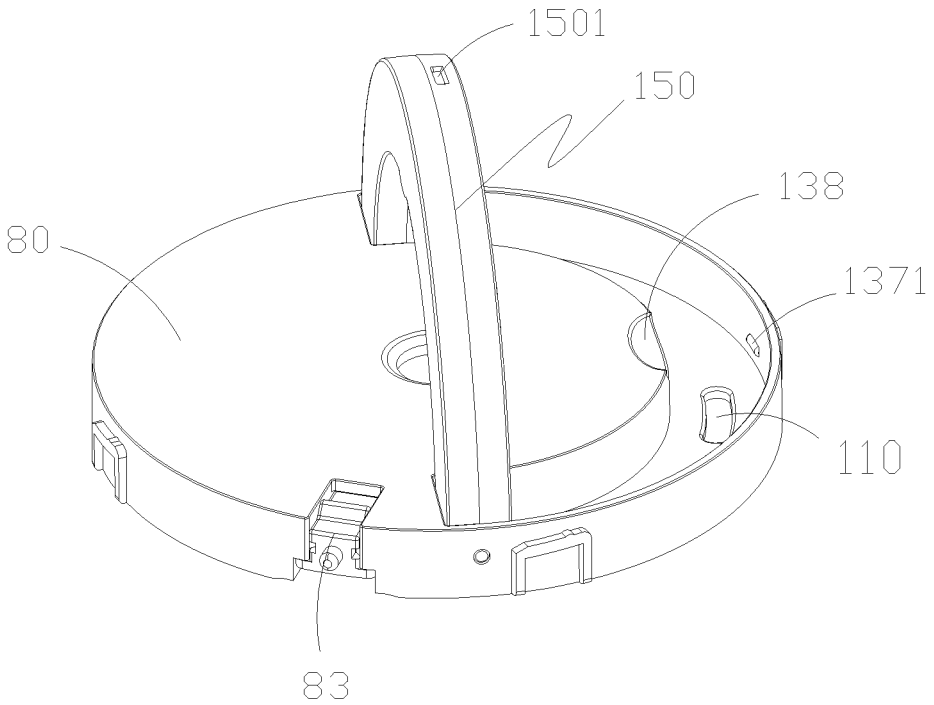
FIG. 36 is a stereoscopic structure diagram of the cover plate from a second perspective according to Example 3 of the disclosure.
Figure 37:
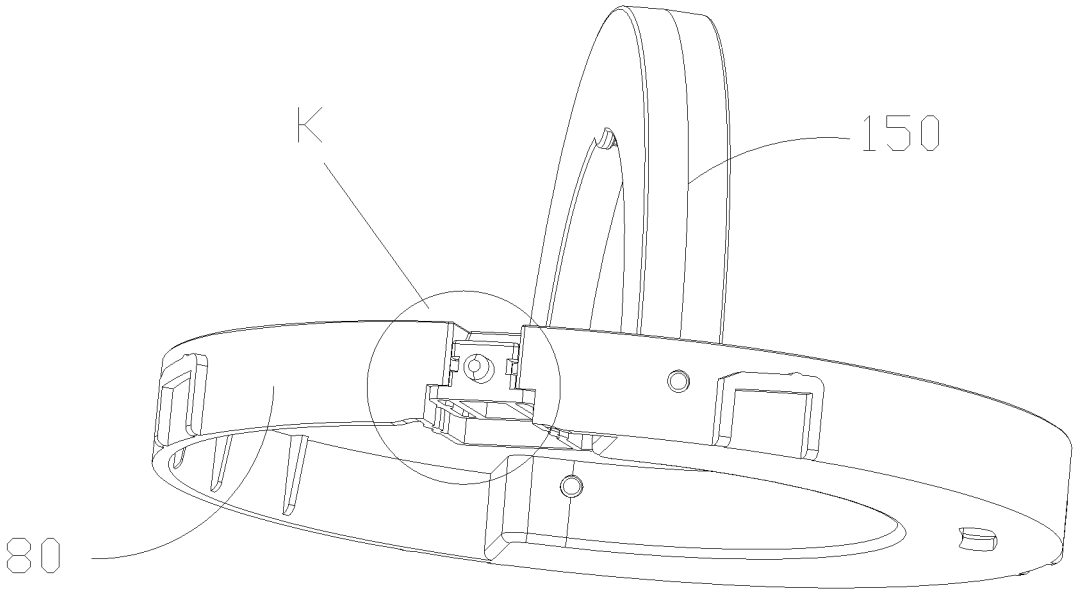
FIG. 37 is a stereoscopic structure diagram of the cover plate from a third perspective according to Example 3 of the disclosure.
Figure 38:
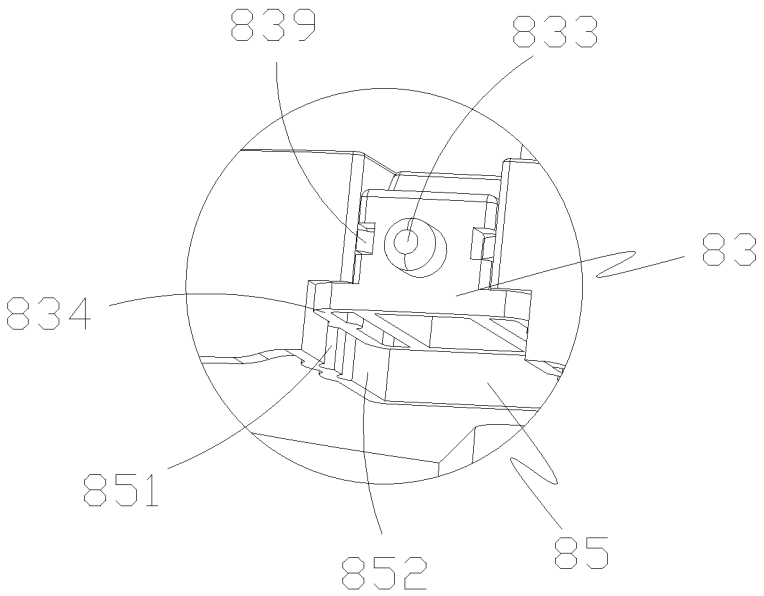
FIG. 38 is an enlarged view of part K in FIG. 37.
Figure 39:
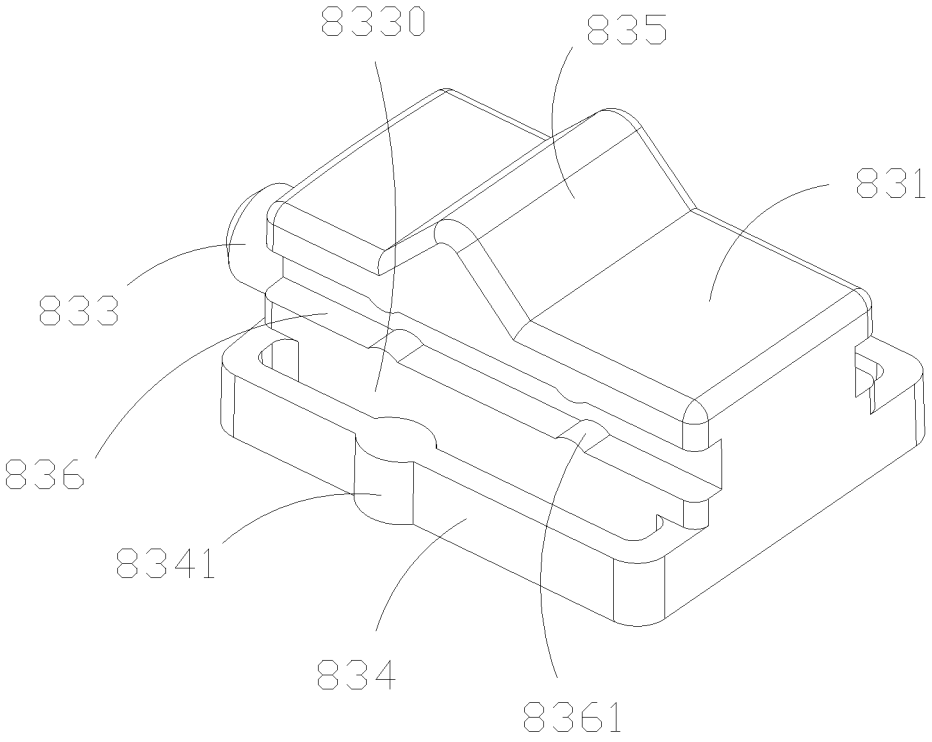
FIG. 39 is a stereoscopic structure diagram of a clamping member according to Example 3 of the disclosure.

As shown in FIGS. 33 and 34, in some embodiments, some reinforcing components are replaced with support components, and the plurality of support components and the plurality of reinforcing components are disposed in a staggered manner. The reinforcing components comprise eighth bearing members 58 and ninth bearing members 59. Each of the ninth bearing members comprises a first bearing portion 591, a second bearing portion 592, a third bearing portion 593, a fourth bearing portion 594 and a fifth bearing portion 595, with the first bearing portion being connected to the fifth bearing member 57, the second bearing portion 592 being connected to the first bearing portion, the third bearing portion 593 being connected to the second bearing portion 592, the fourth bearing portion being connected to the third bearing portion, and one end of the fifth bearing portion being connected to the fourth bearing portion while the other end thereof being connected to the seventh projection 47. The first bearing portion 591, the second bearing portion 592 and the third bearing portion 593 form a product LOGO, so that the structural strength of the connecting pieces is enhanced and the advertising effect is achieved. The eighth bearing members 58 are located between the ninth bearing members 59 and the seventh bearing members 57. One ends of the eighth bearing members are connected to the fifth bearing members, while the other ends thereof are connected to the seventh projections 47.

Figure 31:
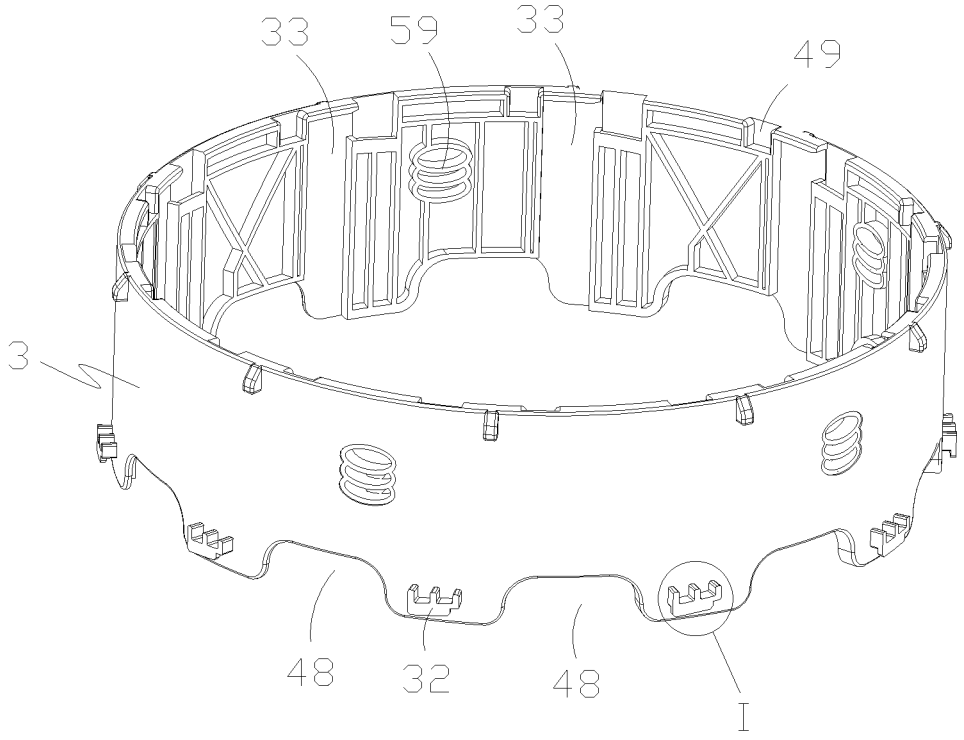
FIG. 31 is a stereoscopic structure diagram of a connecting piece according to Example 3 of the disclosure.
Figure 32:
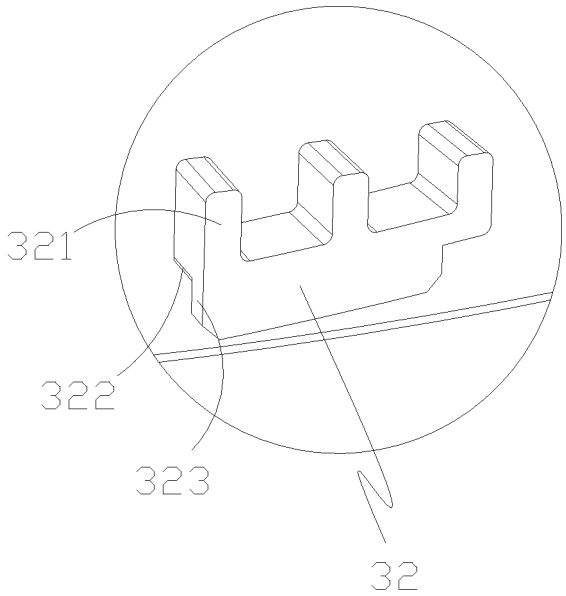
FIG. 32 is an enlarged view of part I in FIG. 31.

As shown in FIGS. 31 and 32, in this embodiment, the general structure of the second limiting portion 32 in this embodiment is the same as that in Embodiment 2, except that: a first limiting bump 324 and a second limiting bump 325 are further disposed on the second limiting portion 32 to enhance the structural strength of the second limiting portion, and the first limiting bump 324, the second limiting bump 325 and the first rotation stopping portion 321 enable the whole second limiting portion to form a W-shaped structure.

As shown in FIGS. 35-39, in some embodiments, a handle portion 150 for gripping is disposed on the cover plate 80. It is convenient to push the cover plate to rotate by the handle portion. A first groove 137 is formed on the cover plate. The handle portion is a semicircular rod structure, and has a hollow middle portion and an opening on one side. A plurality of reinforcing ribs 1502 are disposed on the inner wall of the handle portion. The reinforcing ribs are disposed like a grid, and second grooves 1503 matched with the first movement groove are formed on the reinforcing ribs. The handle portion is rotatably connected to the first groove, a second limiting groove 1501 is formed on the handle portion, and a limiting block 1371 matched with the second limiting groove is disposed on the inner wall of the first groove. A third groove 138 is further formed on the top of the first groove. By providing the third groove, it is convenient to turn the handle portion out from the first groove. During transportation of the telescopic stool, the handle portion is turned out from the first groove, and the whole telescopic stool is directly lifted up by the handle portion. When the handle is in the horizontal state, the switch is located inside the handle portion, so that the switch is protected by the handle, and the switch is prevented from being touched by mistake when the telescopic stool is used.

Further, a first movement groove 110 corresponding to the switch is formed on the cover plate. The switch is connected to the luminous bodies, and the first movement groove is an arc-shaped structure. When the cover plate is covered in the mounting portion, the switch runs through the first movement groove. By providing the first movement groove, the cover plate is able to rotate freely, and the cover plate is prevented from colliding with the switch during rotation.

Further, the clamping member 83 comprises a clamping member body 831, a connecting rod 839 and a first slider 834. The clamping member body is disposed in a rectangular structure, and the connecting rod is disposed at one end of the rectangular block. The first slider 834 is disposed on the sidewall of the clamping member body. A sixth lug 1341 is disposed on the first slider. A first chute 852 matched with the first slider is formed on the inner wall of the mounting groove 85. Two sets of first limiting grooves 851 matched with the sixth lug are formed on the inner wall of the first chute. The two sets of first limiting grooves are formed on the inner wall of two sides of the first chute, and the two sets of first limiting grooves are formed at different positions on the first chute. The bayonet 84 is fitted with the connecting rod. After the connecting rod is inserted into the bayonet 84, the sixth lug is embedded into the first set of first limiting grooves. By fitting the first limiting grooves with the sixth lug, the third anti-escapement portion is fixed, and the fitting effect of the connecting rod and the bayonet 84 is ensured.

In other embodiments, characters OFF/ON are engraved on the cover plate 80 and located on one side of the clamping member 83, so that it is convenient for the user to use.

In other embodiments, characters OFF← →ON are engraved on the cover plate 80 to remain the user of the rotation direction of cover plate 80.

Preferably, the sixth lug is an arc-shaped structure. By using the arc-shaped structure of the sixth lug, the sixth lug will not escape from the first limiting grooves by itself due to its gravity, while the sixth lug is also able to exit the first limiting grooves when an external force is applied, so that the third anti-escapement portion is movable in the mounting groove. When the third anti-escapement portion is completely contracted into the mounting groove, the sixth lug is embedded into the other set of first limiting grooves. A fourth through groove 8330 is formed on the first slider, so that the first slider has a reduced thickness. Thus, when the sixth lug is resisted against the inner wall of the first chute, the first slider is able to produce a small deformation, so that the third anti-escapement portion is allowed to normally move in the mounting groove. A second chute 836 is formed on the third anti-escapement portion, a second slider 839 matched with the second chute is disposed on the inner wall of the mounting groove, four seventh lugs 8361 are disposed on the inner wall of the second chute, and the four lugs are directly resisted against the sidewall of the second chute. By using the four lugs, the friction between the second chute and the second slider is reduced.

Preferably, a bump 835 is disposed on the top of the clamping member body 831, and the top surface of the bump and the top surface of the stool surface are in a sample plane. By providing the bump, it is more convenient to push the third anti-escapement portion to move. The height of the bump is limited, to prevent the bump from resisting against the thigh of the human body and increase the use comfort of the user.

In other embodiments, it is possible that the locking structure is other structures for fixing the cover plate, such as an insertion rod that is telescoped by a spring, and an insertion slot.

In other embodiments, a cushion is further mounted on the stool surface 1. It is possible that the cushion is an antiskid pattern, a sponge cushion, a silicone cushion, a frosted portion or the like that is integrated with the stool surface, or a cushion made of various materials that is detachable from the stool surface 1.

In another embodiment, it is also possible that convex rib structures, artistic lines and limiting planes 329 on the connecting pieces 3, or the above structures are combined with each other or combined with other existing structures.

Figure 41:
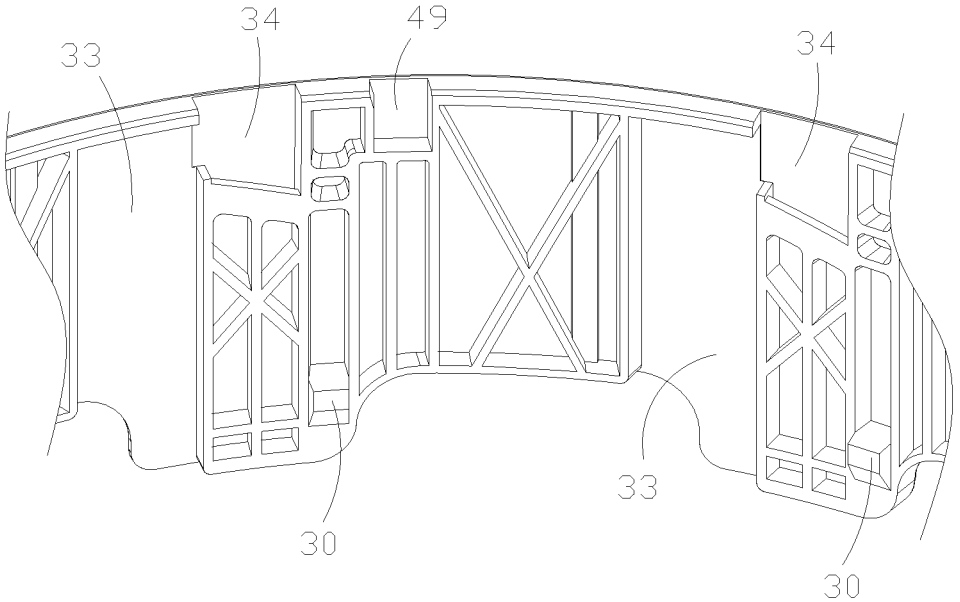
FIG. 41 is a stereoscopic view of providing bearing bumps on the connecting pieces according to the disclosure.

As shown in FIG. 41, in some embodiments, bearing bumps 30 are disposed on the connecting pieces 3. By using a plane perpendicular to the axis of the connecting pieces 3 as a first reference plane, a projection of the bearing bump 30 of any connecting piece 3 onto the first reference plane is at least partially overlapped with a projection of another adjacent connecting piece 3 close to a side of the stool base 1 onto the first reference plane. When the telescopic stool is in the contracted state, the bearing bump 30 on one connecting piece 3 is able to support another adjacent connecting piece 3 close to the stool surface 1, so that the bearing capability is improved. That is, the bearing bumps 30 play a support role between two adjacent connecting pieces 3 when the telescopic stool of the disclosure is completely contracted. Moreover, in the disclosure, as required, the extended state is possibly a completely extended state or an incompletely extended state. The completely extended state is that the second limiting portions 32 on all the connecting pieces 3 are resisted and supported against the first limiting portions 31 on adjacent connecting pieces 3, and the incompletely extended state is that the second limiting portions on some connecting pieces 3 are resisted and supported against the first limiting portions 31 on adjacent connecting pieces 31. Thus, it is possible to form the telescopic stool with a different height as required. In the disclosure, the bearing bumps 30 are located on the inner surfaces of the connecting pieces 3. When the telescopic mechanism is in the contracted state, the bearing bumps 30 on the connecting pieces 3 on a side close to the stool base 2 are at least partially located in the recesses 48 on other adjacent connecting pieces 3 on a side close to the stool surface 1.

It will be obvious to those skilled in the art that changes and modifications may be made, and therefore, the aim in the appended claims is to cover all such changes and modifications.

What is claimed is:

1. A telescopic stool, comprising: a stool surface, a stool base, a telescopic mechanism, and a transition mechanism for connecting the stool surface to the telescopic mechanism; wherein:

the telescopic mechanism is able to be switched between an extended state and a contracted state;

the telescopic mechanism comprises a plurality of connecting pieces capable of moving relative to each other and a fixation mechanism disposed on the plurality of connecting pieces;

the fixation mechanism is configured to keep the telescopic mechanism in the extended state;

the fixation mechanism comprises a first limiting structure configured to provide axial limiting for the connecting pieces;

wherein the first limiting structure comprises first limiting portions disposed on the connecting pieces and second limiting portions matched with the first limiting portions on adjacent connecting pieces;

the fixation mechanism further comprises a second limiting structure configured to provide circumferential limiting for the connecting pieces; and the second limiting structure comprises first slopes disposed on the first limiting portions and second slopes disposed on the second limiting portions, and the first slopes are fitted with the second slopes on adjacent connecting pieces.

2. The telescopic stool of claim 1, wherein the second limiting structure further comprises first rotation stopping portions disposed on the second limiting portions and second rotation portions matched with the first rotation stopping portions on adjacent connecting pieces.

3. The telescopic stool of claim 1, wherein the fixation mechanism further comprises a third limiting structure configured to provide radial limiting for the connecting pieces; and the third limiting structure comprises fifth limiting portions disposed on the connecting pieces and sixth limiting portions matched with the fifth limiting portions on adjacent connecting pieces.

4. The telescopic stool of claim 1, wherein third limiting portions are further disposed on the connecting pieces; defining a plane perpendicular to the axis of the connecting pieces as a first reference plane, a projection of the third limiting portion of any connecting piece onto the first reference plane is at least partially overlapped with a projection of another adjacent connecting piece that is adjacent to a side of the stool base onto the first reference plane.

5. The telescopic stool of claim 4, wherein a plurality of seventh limiting portions are disposed on the connecting pieces; when the telescopic mechanism is in the contracted state, at least part of the third limiting portion on a connecting piece on a side that is adjacent to the stool surface is located in a seventh limiting portion on another adjacent connecting piece on a side that is adjacent to the stool base.

6. The telescopic stool of claim 5, wherein a plurality of bearing bumps are disposed on the connecting pieces; defining a plane perpendicular to the axis of the connecting pieces as a first reference plane, a projection of a bearing bump of any connecting piece onto the first reference plane is at least partially overlapped with a projection of another adjacent connecting piece that is adjacent to a side of the stool base onto the first reference plane.

7. The telescopic stool of claim 6, wherein a plurality of recesses are disposed on the connecting pieces; the telescopic mechanism is in the contracted state, the bearing bumps on the connecting pieces on a side that is adjacent to the stool base are at least partially located in the recesses on other adjacent connecting pieces on a side that is adjacent to the stool surface.

8. The telescopic stool of claim 1, wherein the telescopic mechanism further comprises a limiting structure for preventing two adjacent connecting pieces from separating from each other.

9. The telescopic stool of claim 1, wherein a support mechanism for dispersing the stress of the connecting pieces is disposed on the connecting pieces; and the support mechanism comprises bearing components for providing an axial support force and reinforcing components for providing a radial support force.

10. The telescopic stool of claim 9, wherein the bearing components comprise a plurality of first bearing members disposed on inner walls of the connecting pieces and second bearing members for dispersing the stress of the first bearing members; and the reinforcing components comprise third bearing members disposed obliquely and fourth bearing members matched with the third bearing members.

11. The telescopic stool of claim 10, wherein the third bearing members and the fourth bearing members are crossed with each other, and bearing legs are disposed on the fourth bearing members.

12. The telescopic stool of claim 1, wherein the telescopic stool further comprises an anti-escapement mechanism configured to keep the telescopic stool in the contracted state.

13. The telescopic stool of claim 12, wherein the anti-escapement mechanism comprises a fixation component for interlocking the stool surface and the stool base; and the fixation component comprises a first anti-escapement portion disposed on the stool surface and a second anti-escapement portion matched with the first anti-escapement portion.

14. The telescopic stool of claim 12, wherein the anti-escapement mechanism further comprises an anti-escapement component for preventing the stool surface from moving away from the stool base.

15. The telescopic stool of claim 14, wherein the anti-escapement component comprises a third anti-escapement portion connected to the stool surface and a fourth anti-escapement portion matched with the third anti-escapement portion.

16. The telescopic stool of claim 14, wherein the anti-escapement component comprises an upper connecting portion disposed on the stool surface, a lower connecting portion disposed on the stool base and a resetting member for connecting the upper connecting portion and the lower connecting portion.

17. The telescopic stool of claim 14, wherein the anti-escapement mechanism further comprises a limiting structure configured to prevent the connecting pieces from moving; and the limiting structure comprises a sixth anti-escapement portion disposed on the stool base and a first transition member matched with the sixth anti-escapement portion.

18. A telescopic stool, comprising: a stool surface, a stool base, a telescopic mechanism, and a transition mechanism for connecting the stool surface to the telescopic mechanism; wherein:

the telescopic mechanism is able to be switched between an extended state and a contracted state;

the telescopic mechanism comprises a plurality of connecting pieces capable of moving relative to each other and a fixation mechanism disposed on the plurality of connecting pieces;

the fixation mechanism is configured to keep the telescopic mechanism in the extended state; and the telescopic stool further comprises luminous bodies for generating light and a light transmitting region for allowing the light to be transmitted therethrough.

19. The telescopic stool of claim 18, wherein the light transmitting region is a hollow structure running through one or more of the stool surface, the stool base and the connecting pieces; the hollow structure is an opening formed on the stool surface or openings formed on the connecting pieces.

20. The telescopic stool of claim 18, wherein the light transmitting region is a groove structure disposed on one or more of the stool surface, the stool base and the connecting pieces.

21. The telescopic stool of claim 18, wherein the luminous bodies are disposed on one or more of the stool surface, the stool base and the connecting pieces.

22. The telescopic stool of claim 18, wherein the telescopic stool further comprises a light reflecting region for reflecting the light.

23. A telescopic stool, comprising: a stool surface, a stool base, a telescopic mechanism, and a transition mechanism for connecting the stool surface to the telescopic mechanism; wherein:

the telescopic mechanism is able to be switched between an extended state and a contracted state;

the telescopic mechanism comprises a plurality of connecting pieces capable of moving relative to each other and a fixation mechanism disposed on the plurality of connecting pieces;

the fixation mechanism is configured to keep the telescopic mechanism in the extended state; and the telescopic stool further comprises a mounting portion disposed on the stool surface, a cover plate matched with the mounting portion, and a locking structure for connecting the mounting portion and the cover plate; and the locking structure comprises a mounting groove formed on the cover plate and a clamping member matched with the mounting groove.

24. The telescopic stool of claim 23, wherein the telescopic stool further comprises an extended structure capable of providing auxiliary functions; and the extended structure comprises one or more of a sound box, a wireless charging component, a buzzer and a photovoltaic charging component.

* * * * *